US007167664B2

(12) United States Patent
Nomura et al.

(10) Patent No.: US 7,167,664 B2
(45) Date of Patent: Jan. 23, 2007

(54) IMAGE FORMING APPARATUS WHERE IMAGE WRITE-TO-TRANSFER TIME IS SET INTEGER TIMES OF A ROTATION PERIOD OF IDLER PULLEY

(75) Inventors: Yujiro Nomura, Nagano (JP); Ken Ikuma, Nagano (JP); Manabu Munakata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 219 days.

(21) Appl. No.: 11/001,580

(22) Filed: Dec. 1, 2004

(65) Prior Publication Data

US 2005/0158078 A1 Jul. 21, 2005

(30) Foreign Application Priority Data

Dec. 1, 2003 (JP) ..... P2003-401341
Dec. 1, 2003 (JP) ..... P2003-401342
Dec. 3, 2003 (JP) ..... P2003-404780
Dec. 5, 2003 (JP) ..... P2003-407554

(51) Int. Cl.
*G03G 15/00* (2006.01)

(52) U.S. Cl. ..... 399/167; 399/301; 399/302

(58) Field of Classification Search ..... 399/167, 399/301, 302
See application file for complete search history.

(56) References Cited

U.S. PATENT DOCUMENTS 5,444,525 A * 8/1995 Takahashi et al. ..... 399/76
5,995,802 A * 11/1999 Mori et al. ..... 399/394
6,408,157 B1 * 6/2002 Tanaka et al. ..... 399/301
6,493,533 B1 * 12/2002 Munakata ..... 399/301

FOREIGN PATENT DOCUMENTS

| | | | |
|---|---|---|---|
| JP | 01052175 A | * | 2/1989 |
| JP | 05-072837 | | 3/1993 |
| JP | 2603254 | | 1/1997 |
| JP | 2806617 | | 7/1998 |
| JP | 2002-304033 | | 10/2002 |
| JP | 2003-280313 | | 10/2003 |

* cited by examiner

*Primary Examiner*—Walter Benson
(74) *Attorney, Agent, or Firm*—Hogan & Hartson LLP

(57) ABSTRACT

An image forming apparatus, includes a plurality of image bearing members, respectively provided with image bearing member pulleys coaxially for rotating in one body with the corresponding image bearing members; an idler pulley, disposed between the image bearing members; a single drive belt, wound over the image bearing member pulleys for rotatively driving the image bearing member pulleys; and a tension pulley, adjusting a tension of the drive belt. An image write-to-transfer time of the image bearing member which is disposed on a side closer to the tension pulley than the idler pulley is set integer times of a rotation period of the idler pulley.

14 Claims, 14 Drawing Sheets

IMAGE FORMING APPARATUS WHERE IMAGE WRITE-TO-TRANSFER TIME IS SET INTEGER TIMES OF A ROTATION PERIOD OF IDLER PULLEY

BACKGROUND OF THE INVENTION

The present invention relates to an image forming apparatuses, such as electronic photographs and facsimile machines, and more particularly to a tandem-type image forming apparatus for driving a plurality of image bearing members arranged on a line by one endless image-bearing member drive belt.

Recently, there is known, as an image forming apparatus, a tandem-type image forming apparatus having a plurality of image bearing members for different colors arranged on a line. In such a tandem-type image forming apparatus, even where there is a speed variation between the image bearing members, it is important to correctly align the colors based on each image through the image bearing members. For this reason, by adjusting the phases of the image bearing members and suppressing misalignment of colors, it is possible to align the colors for each image with further correctness. In such a case, when the image bearing members are rotatively driven and adjusted in their phases by gear trains, there encounters an increased number of gears thus requiring a greater space.

For this reason, there is a proposal of an image forming apparatus which has a plurality of image bearing members for different colors to be driven by one endless image bearing member drive belt and formed compact while suppressing misalignment of colors by adjusting the phases of the image bearing members (see JP-B-2806617, for example).

In the image forming apparatus disclosed in JP-B-2806617, a timing belt as one endless image bearing member drive belt is wound over a driving pulley on an output shaft of a drive motor, an image bearing member pulley for yellow (Y), an image bearing member pulley for magenta (M) and an image bearing member pulley for cyan (C). The drive force of the drive motor is transmitted to the image bearing member pulleys by the timing belt. Furthermore, by adjusting the mesh points between the image bearing member pulleys and the timing belt, the phase of positional deviation amount of an image is matched on the image bearing members thus preventing against the occurrence of misalignment of colors. In this case, the timing belt is also wound over a plurality of idler pulleys. Although the function of these pulleys are not definite, there is no disclosure as to having a function of tension pulleys. It can be considered that they are for merely setting up a belt path in order to provide a predetermined mesh at between the timing belt and the image bearing member pulleys.

Meanwhile, there is also a disclosure of an image forming apparatus formed compact which has a plurality of image bearing members to be driven by one endless image bearing member drive belt and formed compact while suppressing concentration irregularities and color misalignment by keeping uniform the behavior of the image bearing members (see JP-A-2002-304033, for example).

In the image forming apparatus disclosed in JP-A-2002-304033, a timing belt as one endless image bearing member drive belt is wound over a driving pulley, black (K) image bearing member pulley, magenta (M) image bearing member pulley and cyan (C) image bearing member pulley to which the power of the drive motor is conveyed. By providing a tension to the timing belt through an idler pulley as one belt tension tightening unit and the tension pulley of another of belt tension tightening unit, the construction is made simple and moreover the plurality of image bearing members are kept even in rotational behavior, thus obtaining a quality image reduced in concentration irregularities and color misalignment.

Furthermore, there is a proposal of an image forming apparatus which has a plurality of image bearing members wound over by timing belts as a plurality of endless image bearing member drive belts, to provide a tension to the timing belts by idler pulleys and convey the drive force of the drive motor by the timing belts to the image bearing member pulleys, wherein a movement time required for the image bearing member to move up to a post-exposure transfer position is set integer times the time required for the driving pulley provided on the drive motor end to rotate once, thereby obtaining a quality color image free of color misalignment occurrence (see JP-A-5-72837, for example).

The image forming apparatus disclosed in JP-A-5-72837 is set with an exposure-to-transfer time on the image bearing member that is integer times a rotation period of the driving pulley, thereby enabling drive conveyance by image bearing members free from the rotation irregularities of the drive motor appearing as image misalignment. In this case, the plurality of idler pulleys for adjusting a tension of the timing belt has a rotation period set equal to the rotation period of the driving pulley, thus preventing against positional deviations of a transfer image due to rotation irregularities of the idler pulleys.

In the meanwhile, in the image forming apparatus disclosed in JP-B-2806617 that the plurality of image bearing members to be driven by the one timing belt merely set with a belt path as noted above through the idler pulleys, the construction is comparatively simple but the tension of the timing belt is not to be adjusted constant. Thus, rotational behavior is not even over the plurality of image bearing members. Therefore, it can be considered in the image forming apparatus disclosed in JP-B-2806617 that, by providing a tension to the timing belt through a tension pulley and keeping the belt tension constant as in the image forming apparatus disclosed in JP-A-2002-304033, rotational behavior is to be kept uniform over the plurality of image bearing members.

However, where using the idler pulley in this manner, the idler pulley involves an eccentricity due to geometrical error, mounting error, etc. In case there is an eccentricity of the idler pulley in this manner, the idler pulley at its outer peripheral surface is to reciprocally move relative to the timing belt during rotation of the idler pulley. Consequently, there is caused a change in the belt path of the timing belt contacting with the outer peripheral surface of the idler pulley, causing speed variations on the timing belt. Because the speed of the image bearing member varies due to the speed variation on the timing belt, transfer images deviate in position thus causing color misalignment. In this case, in the image forming apparatus using the idler pulleys of the image forming apparatus disclosed in JP-B-2806617 and the tension pulley of the image forming apparatus disclosed in JP-A-2002-304033, the driving pulley is connected to the drive motor. Consequently, when the idler pulley at its outer peripheral surface moves reciprocally as in the foregoing, there is a not so much movement in a belt portion positioned closer to the driving pulley than the idler pulley while there is a comparatively great movement in a belt portion positioned closer to the tension pulley than the idler pulley. For this reason, the occurrence of speed variation is greater on the timing belt in a portion positioned closer to the driving pulley than the idler pulley.

Therefore, it can be considered to prevent against the positional deviation of images due to rotational irregularities of the idler pulleys by applying the provision of an exposure-to-transfer time on the image bearing member that is integer times a rotation period of the driving pulley and the setting the rotation period of the idler pulley equal to the rotation period of the driving pulley in the image forming apparatus disclosed in JP-A-5-72837, to an image forming apparatus using such idler pulley and tension pulley as in the foregoing. However, the idler pulley of the image forming apparatus disclosed in JP-A-5-72837 is a tension pulley instead of an idler pulley for merely setting up a belt path as in the foregoing, to which the image forming apparatus disclosed in JP-A-5-72837 cannot be applied. Moreover, because the rotation period of the idler pulley of the image forming apparatus disclosed in JP-A-5-72837 is given equal to the rotation period of the driving pulley, rotation period is restricted on the idler pulley.

By the way, there is a proposal of an image forming apparatus that yellow (Y), magenta (M), cyan (C) and black (K) of image bearing members are mutually positioned in preset reference positions and supported for rotation on an image bearing member support member, to rotatively drive the image bearing members by a belt, wherein a positioning pin is provided on a side plate of the image bearing member support member to thereby acquire color misalignment information with reference to a position of the positioning pin so that, when the image bearing members are deviated in relative position, correction for color misalignment is effected under registration control on the basis of the color misalignment information (see JP-A-2003-280313, for example).

According to the color-misalignment correction disclosed in JP-A-2003-280313, correction is possible for color misalignment resulting from the accuracy in support position of image bearing member shafts, the working accuracy of these shafts, the accuracy in diameter of the image bearing members and the like.

Meanwhile, there is a proposal of an image forming apparatus that register marks for detecting image positions are formed, color by color, at a constant interval over a transfer belt by an electronic photographic process separately from the images to be formed on the transfer member, to read the register marks by a CCD sensor so that correction is made for positional deviation of from a preset reference position between images depending upon an image signal read out (see JP-B-2603254, for example).

The image forming apparatus disclosed in the JP-B-2603254 is adapted to easily correct for positional deviation in a direction of transfer material conveyance (top margin), positional deviation in a scanning direction (left margin), inclination deviation in an oblique direction and image-to-image deviation resulting from magnification error, by the register marks, thus making it possible to form a quality image.

As disclosed in JP-A-2002-304033 and JP-B-2603254, correct-controlling the positional deviation from a preset reference position between a plurality of images to thereby correct for color misalignment due to the positional deviation is referred, in the invention, to as correction for color misalignment based on registration control.

In the meanwhile, because of the presence of a contact between the image bearing members and a transfer member of a transfer device and a speed difference between the peripheral speed of the image bearing member and the peripheral speed of the transfer member, a resistance force is caused to act between the image bearing member and the transfer member. Because of an elongation caused in the image bearing member drive belt by the resistance force, positional deviations occur in the pre-adjusted phase condition of the image bearing members to thereby cause color misalignment in each image.

However, in the image forming apparatuses disclosed in JP-B-2806617 and JP-A-2002-304033, prevention is made against the color misalignment in each image caused by the image bearing members through keeping an adjusted phase of the image bearing member pulleys and the timing belt. Nevertheless, no consideration is made at all as to the foregoing color misalignment in the image due to an elongation of the image bearing member drive belt. Particularly, in the image forming apparatus having an intermediate transfer belt to which toner images on the image bearing members are transferred, a resistance force is caused to act also upon the intermediate transfer belt due to the friction between the image bearing member and the intermediate transfer belt. Due to this, because color misalignment is caused in the mage due to an elongation of the intermediate transfer belt, there is a problem of a partial increase of color misalignment due to the respective elongations of the both belts.

Further, in the image forming apparatuses disclosed in JP-B-2806617 and JP-A-2002-304033, the driving pulley is provided greatly spaced from image bearing member pulleys arranged tandem on a line, in a line perpendicular to an arrangement line of the image bearing member pulleys. Consequently, because the belt length of the image bearing member drive belt is increased, the image bearing member drive belt is increased in elongation amount, therefore, the color misalignment is further increased. Moreover, despite the use of a belt provides compactness as compared to gear train driving to the image bearing members, the arrangement structure of the driving pulley requires a large arrangement space thus raising a problem of impeding the precious compactness.

Furthermore, although the image forming apparatus disclosed in JP-A-2003-280313 can correct for misalignment of colors resulting from the accuracy in support position of image bearing member shafts, the working accuracy of these shafts, the accuracy in diameter of the image bearing members and the like, it does not yet consider color misalignment in each image due to an elongation of the image bearing member drive belt and an elongation of the intermediate transfer belt.

Furthermore, the image forming apparatus disclosed in JP-B-2603254, although corrects for positional deviations between a plurality of images by resister marks, does not yet consider the elongation of the image bearing member drive belt and image-based color misalignment due to elongation of the intermediate transfer belt.

SUMMARY OF THE INVENTION

The present invention has been made in view of such circumstances, and a first object thereof is to provide a simple-structured image forming apparatus, having idler pulleys and tension pulleys, capable of effectively preventing a misalignment of colors by reducing the effect of speed variation over the image bearing member drive belt caused due to an eccentricity of the idler pulley.

Further, a second object of the present invention is to provide an image forming apparatus capable of being formed further compact while suppressing the color misalignment of toner images to be transferred respectively from a plurality of image bearing members onto an intermediate transfer belt.

In order to achieve the above object, according to the present invention, there is provided an image forming apparatus, comprising:

a plurality of image bearing members, respectively provided with image bearing member pulleys coaxially for rotating in one body with the corresponding image bearing members;

an idler pulley, disposed between the image bearing members;

a single drive belt, wound over the image bearing member pulleys for rotatively driving the image bearing member pulleys; and a tension pulley, adjusting a tension of the drive belt, wherein an image write-to-transfer time of the image bearing member which is disposed on a side closer to the tension pulley than the idler pulley is set integer times of a rotation period of the idler pulley.

Preferably, the image write-to transfer time is a rotation period of time of the image bearing member from exposing position of an image to a primary transfer position.

Preferably, the image bearing member on a side closer to the tension pulley are provided in plurality; and wherein image write-to-transfer times of all the image bearing members on a side closer to the tension pulley are set the integer times of the rotation period of the idler pulley.

Preferably, the image forming apparatus further comprises an image bearing member phase matching unit, matching phases of all the image bearing members on a side closer to the tension pulley.

Preferably, the idler pulley is provided in plurality, and the image forming apparatus further comprising an idler pulley phase matching unit which matches phases of the idler pulleys.

According to the image forming apparatus of the invention, the image write-to-transfer time on the image bearing members on a side closer to the tension pulley than the idler pulley is set integer times a rotation period of the idler pulley. Because of the capability of effectively preventing the image misalignment on the image bearing members on a side closer to the idler pulley caused due to an eccentric rotation of the idler pulley, a quality color image can be obtained free from an occurrence of color misalignment.

Meanwhile, because a belt path is set up by the idler pulley and wherein the plurality of image bearing members are all rotated by one image bearing member drive belt given with a predetermined tension by use of the tension pulleys, the construction of the image bearing member drive system can be made simple and the number of component parts can be reduced.

Preferably, the image forming apparatus further comprising:

a drive member, rotatively driving the drive belt;

an intermediate transfer belt, onto which toner images are transferred from the image bearing members; and an intermediate transfer belt drive member, rotatively driving the intermediate transfer belt, wherein one of the image bearing members is for a black and the other is for other colors than black;

wherein the drive member is disposed on or near a line along a row of the image bearing member pulleys;

wherein the drive member is disposed at a same side as the intermediate transfer belt drive member with respect to a direction toward the intermediate transfer belt drive member in the line along the row of the image bearing member pulleys;

wherein the image bearing member for black is disposed in a closest position to the drive member; and wherein the image bearing member for less visible color of the colors other than black is disposed in a most distant position away from the drive member.

Preferably, a moving speed of the drive belt is difference from a moving speed of the image bearing member drive belt.

Preferably, the colors other than black of the image bearing member are yellow (Y), magenta (M) and cyan (C). The image bearing member for yellow (Y) is disposed in the most distant position away from the drive member.

According to the image forming apparatus of the invention, the image bearing member-drive-belt drive member is provided on a side close to the intermediate transfer belt drive member with respect to a moving direction of the belt portion of intermediate transfer belt opposed to the image bearing members and the belt portion of image bearing member drive belt closer to the intermediate transfer belt, the black image bearing member being provided in a closest position to the image bearing member-drive-belt drive member while the image bearing member for a least visible color being provided in a position distant the most from the image bearing member-drive-belt drive member. Accordingly, should a misalignment of colors occur resulting from the elongations of the intermediate transfer belt and image bearing member drive belt, it is possible to effectively reduce the effect of color misalignment in a visual sense. Thus, it is possible to obtain a quality full-color image can be obtained in visual sense.

Meanwhile, because the image bearing member-drive-belt drive member for rotatively driving the image bearing member drive belt for the image bearing member is provided on a line or nearly on a line with the image bearing member pulley row of the image bearing member pulleys, the image bearing member drive belt can be shortened in belt length. Because this can reduce the amount of belt elongation, it is possible to effectively suppress the color misalignment due to belt elongation. Moreover, there is no possibility that the image bearing member-drive-belt drive member goes distant greatly in a direction orthogonal to the image bearing member pulley row from the image bearing member pulley row of the image bearing member pulleys. Thus, there is eliminated a need of a large arrangement space, making it possible to improve compactness.

Preferably, the image forming apparatus further comprises:

a drive member, rotatively driving the drive belt;

an intermediate transfer belt, onto which toner images are transferred from the image bearing members; and an intermediate transfer belt drive member, rotatively driving the intermediate transfer belt, wherein the drive member is disposed on or near a line along a row of the image bearing member pulleys;

wherein the drive member is disposed at a same side as the intermediate transfer belt drive member with respect to a direction toward the intermediate transfer belt drive member in the line along the row of the image bearing member pulleys; and wherein a correction for color misalignment under registration control is performed with a reference color for which the image bearing member is disposed in a closest position to the drive member.

Preferably, the image forming apparatus further comprises a main body; and an image bearing member support member, attached on the main body, wherein the image bearing member support member relatively positioning the image bearing members and rotatably supporting the image bearing members.

Preferably, the image forming apparatus further comprises a positioning member which positions the image bearing member support member in a predetermined position of the main body, wherein the positioning member is a shaft of the image bearing member for the reference color.

According to the image forming apparatus of the invention, the image bearing member-drive-belt drive member is provided on a same side as the intermediate transfer belt drive member with respect to a moving direction of a belt portion of the intermediate transfer belt opposed to the plurality of image bearing members and a belt portion of the image bearing member drive belt closer to the intermediate transfer belt, and wherein, furthermore, correction for color misalignment is to be made under registration control by providing a reference color to the image bearing member provided in a closest position to the image bearing member-drive-belt drive member. Thus, color-misalignment correction based on registration control can be carried out by taking as a reference color a color based on the image bearing member smaller in the amount of color misalignment due to an elongation of the intermediate transfer belt and an elongation of the image bearing member drive belt. This can make proper the amount of misalignment of colors. Therefore, in case a misalignment of colors occurs resulting from an elongation of the intermediate transfer belt and elongation of the image bearing member drive belt, the effect of color misalignment can be effectively reduced, to obtain a quality full-color image.

Meanwhile, because the image bearing member-drive-belt drive member for rotatively driving the image bearing member drive belt for the image bearing members is provided on a line with or nearly on a line with an image bearing member pulley row of the image bearing member pulleys, the image bearing member drive belt can be shortened in belt length. Due to this, because the image bearing member drive belt can be decreased in elongation amount, color misalignment due to belt elongation can be suppressed further effectively. Moreover, there is no possibility that the image bearing member-drive-belt drive member goes distant greatly from the image bearing member pulley row of the image bearing member pulleys in a direction orthogonal to the image bearing member pulley row. Thus, there is eliminated a need of a large arrangement space, making it possible to improve compactness.

Particularly, because the plurality of image bearing members are relatively positioned in position and supported for rotation on the image bearing member support member, the plurality of image bearing members can be easily attached on the main body while improving the accuracy of mutual alignment thereof.

Meanwhile, the shaft of the image bearing member for the reference color is used also as positioning means for positioning the image bearing member support member in a predetermined position of the main body, exclusive positioning means can be made unnecessary. Therefore, the number of component parts can be reduced to lower manufacture cost.

Preferably, the image forming apparatus further comprises:

a drive member, rotatively driving the drive belt;

an intermediate transfer belt, onto which toner images are transferred from the image bearing members; and an intermediate transfer belt drive member, rotatively driving the intermediate transfer belt, wherein one of the image bearing members is for a black and the other is for other colors than black;

wherein the drive member is disposed on or near a line along a row of the image bearing member pulleys;

wherein the drive member is disposed at a opposite side to the intermediate transfer belt drive member with respect to a direction toward the intermediate transfer belt drive member in the line along the row of the image bearing member pulleys;

Preferably, a moving speed of the drive belt is difference from a moving speed of the image bearing member drive belt.

Preferably, the image bearing members are either three image bearing members for yellow (Y), magenta (M) and cyan (C) or four image bearing members for yellow (Y), magenta (M), cyan (C) and black (K).

According to the image forming apparatus of the invention, the image bearing member-drive-belt drive member is provided on a side opposite to the intermediate belt drive member with respect to a moving direction of a belt portion of the intermediate transfer belt opposed to the plurality of image bearing members and a belt portion of the image bearing member drive belt at a side closer to the intermediate transfer belt. It is possible to suppress, nearly to the even, the total amount of color misalignment resulting from an elongation of the intermediate transfer belt and a color misalignment resulting from an elongation of the image bearing member drive belt. This can obtain a quality full-color image suppressed in misalignment amount of colors caused due to the respective elongations of the both belts.

Meanwhile, because the image bearing member drive belt for rotatively driving the image bearing members is provided on a line or nearly on a line with an image bearing member pulley row of the image bearing member pulleys, the image bearing member drive belt can be shortened in belt length. This can reduce the elongation amount of the image bearing member drive belt, making it possible to further effectively suppress against the color misalignment due to an elongation of the belt. Moreover, because there is no possibility for the image bearing member-drive-belt drive member to go distant greatly from the image bearing member pulley row of the image bearing member pulleys, in a direction orthogonal to the image bearing member pulley row. Thus, there is eliminated a need of a large arrangement space, enabling to improve compactness.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Hereunder, explanations will be made on the best mode for carrying out the invention, by use of the drawings.

Figure 1:
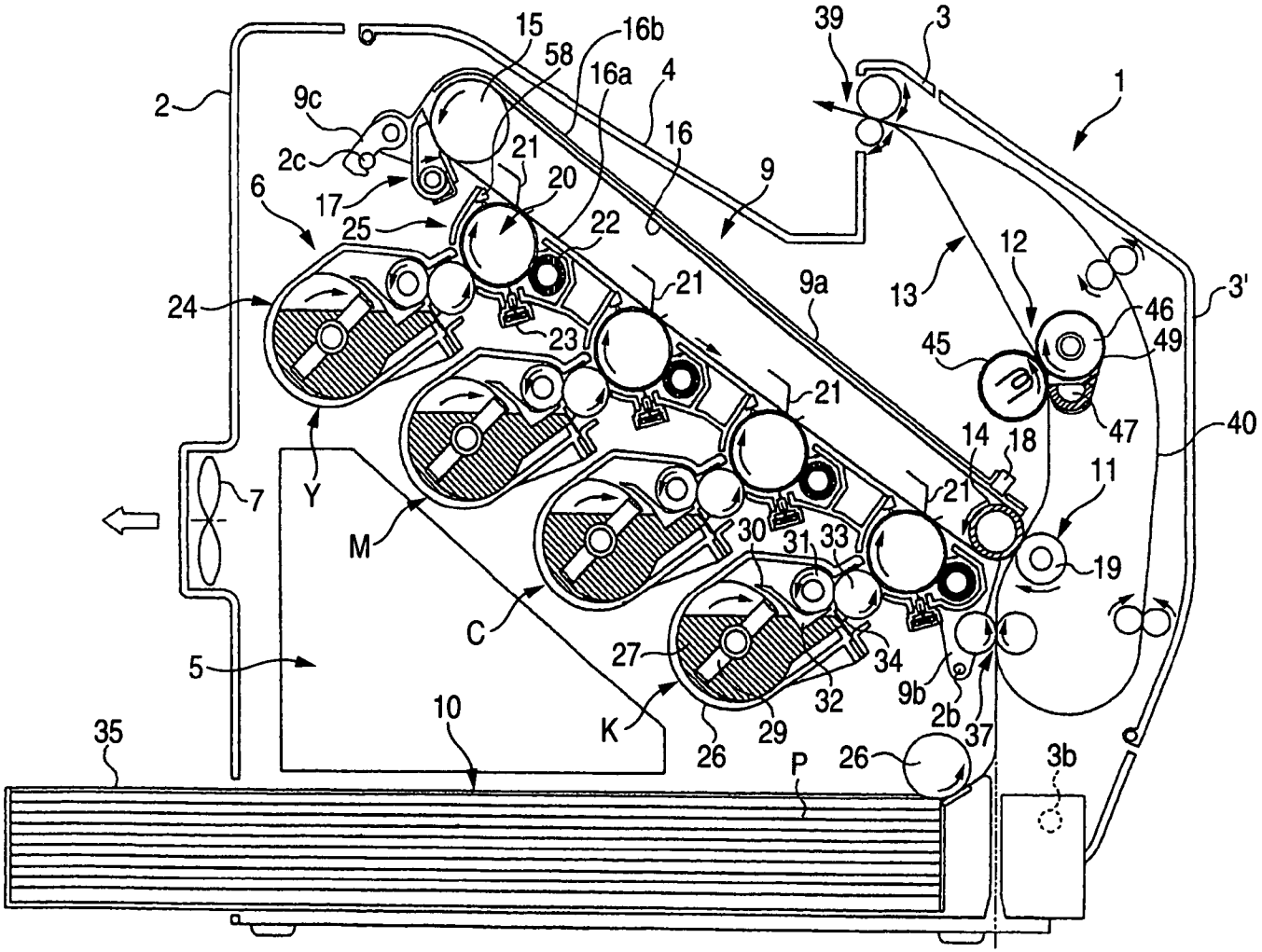
FIG. 1 is a cross-sectional view typically showing one example of an image forming apparatus according to embodiments of the present invention.

FIG. 1 is a cross-sectional view typically showing one example of an image forming apparatus of the present invention.

As shown in FIG. 1, the image forming apparatus 1 according to a first embodiment includes a housing main body 2, a first opening-closing member 3 attached on a front surface (right-side surface in FIG. 1) of the housing main body 2 so as to be opened-closed freely, and a second opening-closing member 4 (serving also as a paper discharge tray) attached on a top surface of the housing main body 2 so as to be opened-closed freely. The first opening-close member 3 is provided with an opening-closing lid 3' attached, to be opened and closed, on the front surface of the housing main body 2. The opening-closing lid 3' can be opened and closed associatively with or independently of the first opening-closing member 3.

An instrumental box 5 having a power circuit board and a control circuit board therein, an image forming unit 6, an air fan 7, a transfer belt unit 9 and a feed paper unit 10 are respectively provided in the housing main body 2. Meanwhile, a secondary transfer unit 11, a fixing unit 12 and a recording-medium transport unit 13 are respectively provided in the first opening-closing member 3. The supplies within the image forming unit 6 and paper feed unit 10 are structured removable from the housing main body 2, i.e. those are to be repaired or exchanged by being removed including the transfer belt unit 9. The first opening-closing member 3 is fit, to be opened and closed, on the housing main body 2 through rotary shafts 3*b* provided at both ends in the lower front of the housing main body 2.

The transfer belt unit 9 has a driving roller 14 to be rotatively driven by a not-shown drive source arranged underneath the housing main body 2, a driven roller arranged obliquely above the driving roller 14, an intermediate transfer belt 16 stretched over between the driving roller 14 and the driven roller 15 and to be rotatively driven in the arrow shown in the figure, and a cleaning unit 17 to be brought into and out of abutment against a surface of the intermediate transfer belt 16. In this case, the driven roller 15 and the intermediate transfer belt 16 arranged in a direction inclining toward the upper left in the figure relative to the driving roller 14. This places a belt portion 16*a* at a side opposed to the image bearing members lower in position than the opposite side to the belt portion 16*a*, or a belt portion 16*b* at a side not opposed to the image bearing members, and wherein the belt portion 16 is given a moving direction of obliquely lower right in the figure. In this case, in the example, the belt portion 16*a* lies on a tight-belt side during driving the belt (on a side pulled by the driving roller 14) while the belt portion 16*b* on a loose-belt side during driving the belt. Thus, toner images are primarily transferred (intermediately transferred) from the image bearing members 20 onto the belt portion 16*a*.

The driving roller 14 and the driven roller 15 are both rotatably supported on a support frame 9*a*. The support frame has a lower end (right end in FIG. 1) formed with a swing portion 9*b*. The swing portion 9*b* is supported by fit on a rotary shaft (rotary fulcrum) 2*b* provided on the housing main body 2. Due to this, the support frame 9*a* is fit swingable on the housing main body 2. Meanwhile, a lock lever 9*c* is rotatably supported at a top end of the support frame 9*a*. The lock lever 9*c* is engagable with an engaging shaft 2*c* provided on the housing main body 2. The driving roller 14 constitutes a secondary transfer unit 11 and serves also as a backup roller for the secondary transfer roller 19 to be pressure-contacted with the driving roller 14 and intermediate transfer belt 16. Meanwhile, the driven roller 15 serves also as a backup roller for the cleaning unit 17. Furthermore, the cleaning unit 17 is provided on a side closer to the belt portion 16*a* positioned lower right with respect to the conveyance direction.

Primary transfer members 21 made of leaf-spring electrodes are abutted, by their own elastic forces, against the backside of the belt portion 16*a* directed lower right in the conveyance direction of the intermediate transfer belt 16, oppositely to the image bearing members 20 of image forming stations Y, M, C, K, referred later. Transfer bias is applied to the primary transfer members 21. A test pattern sensor 18 is provided on the support frame 9*a* of the transfer belt unit 9, in a position close to the driving roller 14. The test pattern sensor 18 is a sensor which positions the colored toner images in position over the intermediate transfer belt 16, and detects the concentrations of the colored toner images to thereby correct for misalignment of colors and image concentrations of the colored images.

The image forming unit 6 has image forming stations Y (for yellow), M (for magenta), C (for cyan) and K (black) for forming a plurality of images (four in this embodiment; hereinafter explained as four) in different colors, i.e. yellow, magenta, cyan and black. In this case, the image stations Y, M, C, K are arranged tandem in an arrangement order of Y, M, C and K from the driving roller 15 toward the driven roller 14.

Incidentally, the arrangement order of image stations Y, M, C, K can be arbitrary set without limited to the order shown in FIG. 1. In the below explanation, the arrangement order of image stations Y, M, C, K is explained on the assumption set in the order shown in FIG. 1.

Meanwhile, each of these image forming stations Y, M, C, K has an image bearing member 20 formed by a photoconductive drum and a charging unit 22, an image writing unit 23, a developing unit 24 and a charge-removing unit 58 that are arranged around the image bearing member 20.

Because of the same structure of the image bearing members 20, the charging unit 22, the image writing unit 23, the developing unit 24 and a charge-removing unit 58 between the image forming stations for the respective colors, references 20, 22, 23, 24 and 58 in FIG. 1 are respectively given to the charging unit 22, the image writing unit 23, the developing unit 24 and the charge-removing unit 58 of the yellow image forming station Y, thereby omitting to put these references to the charging unit, the image writing unit, the developing unit and charge-removing unit of the image forming stations for the other colors.

The image bearing members 20 of the image forming stations Y, M, C, K are each arranged in a manner abutted against the opposed belt portion 16*a* directed down in conveyance direction of the intermediate transfer belt 16. As a result, likewise the intermediate transfer belt 16, each image forming station also has an arrangement directed toward the oblique upper left in the order of K, C, M and Y from the driving roller 14 in FIG. 1. The image bearing members 20 are rotatively driven clockwise as shown the arrow in FIG. 1, i.e. in the same direction at the contact point of image bearing member 20 with the belt portion 16*a* as the conveyance direction of the belt portion 16*a*. The cleaning unit 17 is provided on the intermediate transfer belt 16 so that the remaining toner from the secondary transfer can be recovered by the cleaning unit 17.

The charging unit 22 is configured by a conductive brush roller connected to a high-voltage generating source. The brush at its outer periphery rotates inversely in moving direction to and in abutment against the image bearing member 20 at a circumferential speed of 2–3 times the circumferential speed of the image bearing member 20, thereby uniformly charging the surface of the image bearing member 20. Because the use of such charging unit 23 electrifies the image bearing member surface by use of an extremely small amount of current, there is no possibility that the apparatus interior/exterior is contaminated by a great deal of ozone as possibly encountered in the corona charging scheme. Meanwhile, because of soft abutment between the charging unit 22 and the image bearing member 20, there is less occurrence of solidification of the remaining toner from transfer to the charging roller as caused in using the roller charging scheme. Thus, it is possible to secure stable image quality and apparatus reliability.

The image writing unit 23 employs an organic EL array exposure head (line head) having organic EL light-emitting elements arranged in a row axially of the image bearing member 20. Because the organic EL array exposure head is shorter in optical length and more compact than the laser scanning optical system, it can be arranged in proximity to the image bearing member 20. Thus, there is a merit that the apparatus main body can be size-reduced.

In this example, the image bearing member 20, the charging unit 22 and the image writing unit 23 of each image forming station Y, M, C, K is unitized as one image bearing member unit 25 so that it can be exchanged together with the transfer belt unit 9. In this configuration, the positioning of the organic EL array exposure head is held relative to the image bearing member head 20, therefore, when the image bearing member unit 25 is exchanged, the organic EL array exposure head is also exchanged.

Next, the developing unit 24 is explained in detail representatively on the black image forming station K. The developing unit 24 is structured with a toner reservoir 26 for storing a toner (hatching shown in FIG. 1), a toner reserve 27 formed within the toner reservoir 26, a toner stir member 29 arranged within the toner reservoir 27, a partition member 30 formed demarcating the upper in the toner reservoir 27, a feed toner roller 31 arranged above the partition member 30, a blade 32 provided on the partition member 30 and put in abutment against a toner feed roller 31, a developing roller 33 arranged in a manner abutted against the feed toner roller 31 and an image bearing member 20, and a regulation blade 34 abutted against the developing roller 33.

The image bearing member 20 is rotated in the conveyance direction of the intermediate transfer belt 16 while the developing roller 33 and feed roller 31 is rotatively driven in a direction inverse to the rotational direction of the image bearing member 20 as shown by the arrow in FIG. 1. Meanwhile, the stir member 29 is rotatively driven in a direction inverse to the rotational direction of the feed roller 31. Within the toner reservoir 27, the toner stirred and taken up by the stir member 29 is fed along the upper surface of the partition member 30 onto the toner feed roller 31. The fed toner is frictionally slid over the blade 32 and supplied onto the surface of the developing roller 33 by a mechanical adhesion force to the surface concavo-convex of the toner feed roller 31 and an adhesion force due to a frictional charging force. The toner fed to the developing roller 33 is regulated by the regulation blade 34 into a predetermined thickness. The toner layer reduced in thickness is conveyed to the image bearing member 20, to thereby develop a latent image on the image bearing member 20 at and around a nip constituted by a contact between the developing roller 33 and the image bearing member 20.

The charge-removing unit 58 is arranged between the developing unit 24 and the primary transfer region (region for primarily transferring a toner image by abutting the primary transfer member 21 against the image bearing member 20). The charge-removing unit 58 is arranged to remove the image bearing member 20 of charge in advance of primary transfer. By thus removing the image bearing member 20 of charge, the image bearing member 20 prior to primary transfer can be made constant in potential and hence constant in electrostatic adsorbing force. This configuration can prevent against the variation of a frictional force at between the image bearing member 20 and the intermediate transfer belt 16, thus making it possible to suppress the intermediate transfer belt 16 from varying in elongation.

The feed paper unit 10 has a paper cassette 35 in which recording mediums P such as paper sheets are held stacked, and a pickup roller 36 for feeding recording mediums P one by one from the paper cassette 35. Inside the first opening-closing member 3, there are further arranged paired resist rollers 37 for adjusting the feed timing of recording medium P to the secondary transfer region, a pared discharge rollers 39 and a both-sided-printing conveyance passage 40.

Furthermore, the fixing unit 12 has a heating roller 45 incorporating a heater such as a halogen heater and arranged rotatable, a pressure-applying roller 46 for urging the heating roller 45, a belt tightening member 47 arranged for swing on the pressure-applying roller 46, and a heat-resisting belt 49 stretched over between the heating roller 45 and the belt tightening member 47. Thus, the color image secondarily transferred to the recording medium P is fixed on the recording medium at a predetermined temperature in the nip point formed by the heating roller 45 and heat-resisting belt 49 of the fixing unit 12. In this example, because of extension of the intermediate transfer belt 16 directed in the oblique upper left from the driving roller 14 toward the driven roller, the fixing unit 12 can be arranged in a space formed in the oblique upper light of the intermediate transfer belt 16, i.e. in a space on a side opposite to the image forming unit 6 with respect to the intermediate transfer belt 16. Heat transfer can be decreased from the fixing unit 12 to the instrumental box 5, image forming unit 6 and intermediate transfer belt 16, thus making it possible to reduce the frequency of implementing color-misalignment correction operations for the colors.

By the way, in the image forming apparatus 1 of the first embodiment, the image bearing members 20 are rotatively driven by one image bearing member drive belt. Explanation is made on rotational drive to the image bearing members by this belt.

Figure 2:
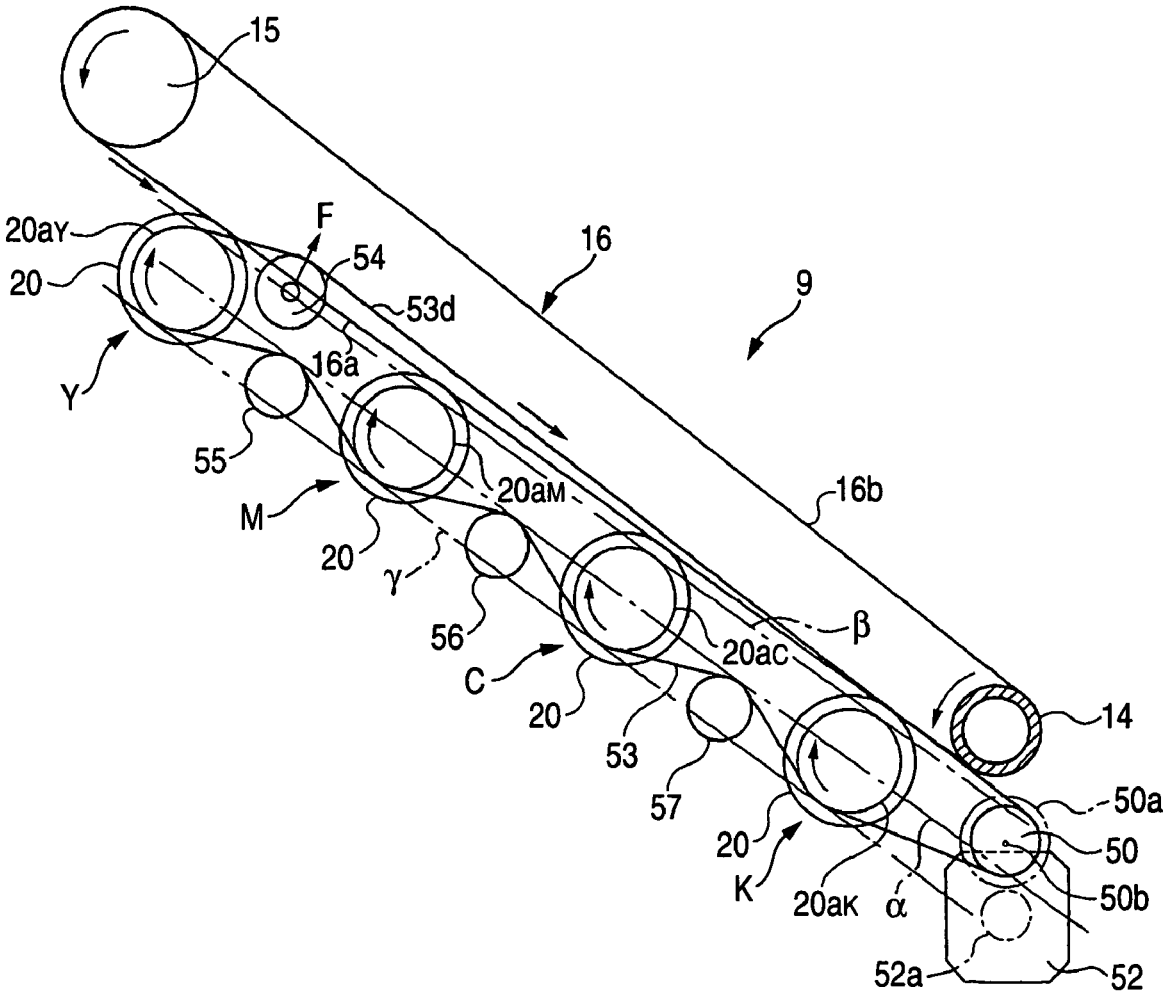
FIG. 2 is a view typically showing an intermediate transfer belt and an image bearing member drive belt according to a first embodiment of the invention.
Figure 3:
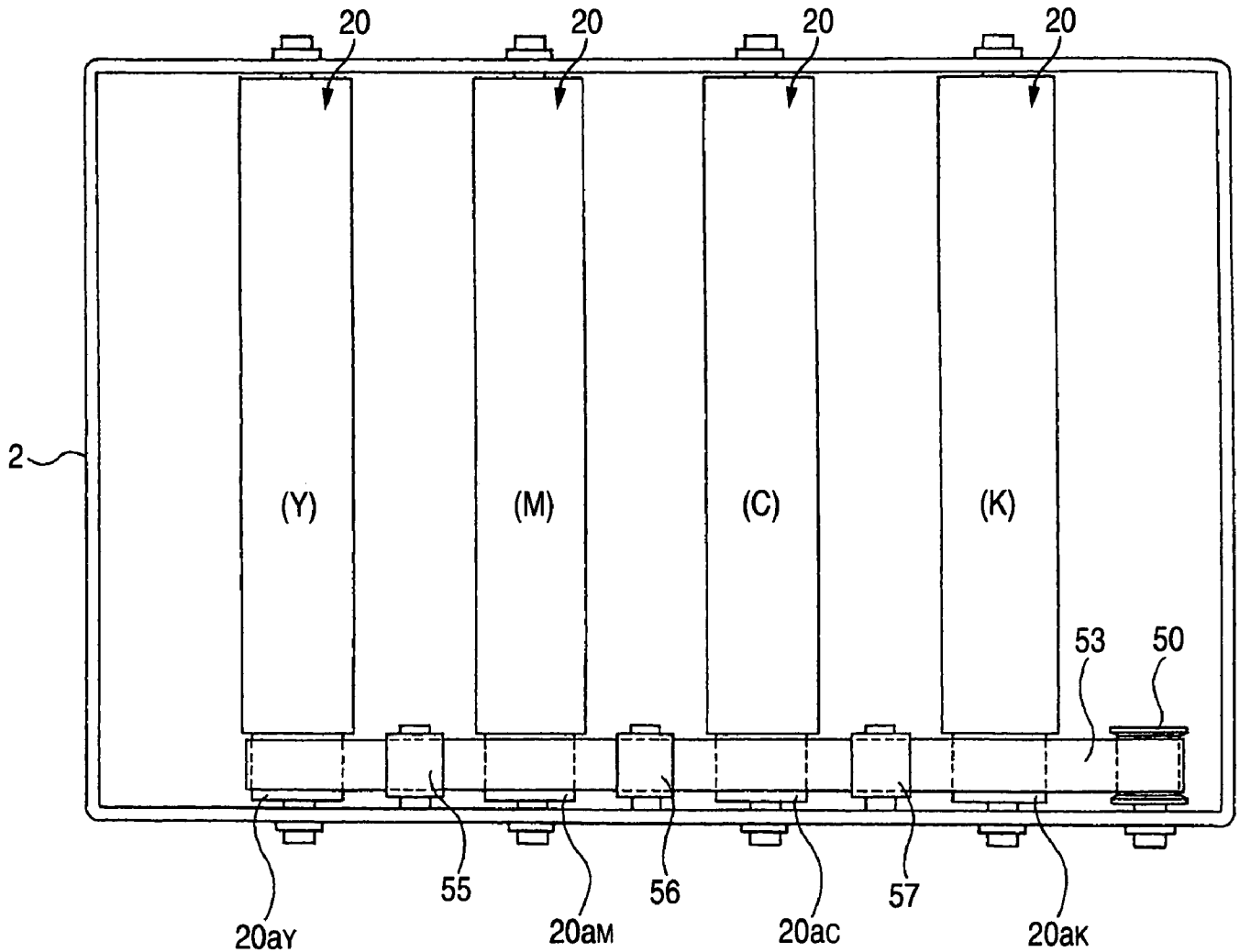
FIG. 3 is a bottom view typically showing the image bearing members and the image bearing member drive belt shown in FIG. 1.

As shown in FIGS. 2 and 3, an image bearing member driving pulley 50 is arranged close to the driving roller 14 for the intermediate transfer belt 16. Consequently, the black (K) image bearing member 20 is provided in a position closest to the driving roller 14 and image bearing member driving pulley 50 while the yellow (Y) image bearing member 20 is provided in a position the most distant from the driving roller 14 and image bearing member driving pulley 50.

Incidentally, in the image forming apparatus 1 of this embodiment, concerning the arrangement order of the image stations Y, M, C, K, as long as the black image station B is provided in a position closest to the driving roller 14 and image bearing member driving pulley 50 while the yellow image station Y is provided in a position the most distant from the driving roller 14 and image bearing member driving pulley 50, the remaining magenta image station M and image cyan image station C may be inverse in arrangement order.

Meanwhile, these image bearing member driving pulleys 50 are arranged on one side widthwise (scanning direction) of the image bearing members 20 (the lower in FIG. 3). The image bearing member driving pulleys 50 are to be driven by an image bearing member drive motor 52. In such a case, the power of the image bearing member drive motor 52 is conveyed to the image bearing member driving pulley 50 through a motor gear 52*a* of image bearing member drive motor 52 and a pulley gear 50*a* of image bearing member driving pulley 50 in mesh therewith.

The image bearing members 20 respectively have, at one end, image bearing member pulleys $\mathbf{20}a_Y$, $\mathbf{20}a_M$, $\mathbf{20}a_C$, $\mathbf{20}a_K$ provided coaxially to and for rotation in one body with the corresponding image bearing member 20. The image bearing member pulleys $\mathbf{20}a_Y$, $\mathbf{20}a_M$, $\mathbf{20}a_C$, $\mathbf{20}a_K$ at their centers are arranged on a straight line a parallel with the belt portion 16*a*, thus forming an image bearing member pulley row. Meanwhile, the image bearing member driving pulley 50 has a center 50*b* somewhat deviated toward the intermediate transfer belt 16 from the straight line α, thus being arranged nearly on a line with the image bearing member pulley row of the image bearing member pulleys $\mathbf{20}a_Y$, $\mathbf{20}a_M$, $\mathbf{20}a_C$, $\mathbf{20}a_K$. In this case, the arrangement of the image bearing member driving pulley 50 nearly on a straight line refers to such an extent that the image bearing member driving pulley 50 at its center 50*b* is placed in a region between the common tangent lines β, γ on the outer peripheries of the image bearing member pulleys $\mathbf{20}a_Y$, $\mathbf{20}a_M$, $\mathbf{20}a_C$, $\mathbf{20}a_K$. Incidentally, the image bearing member driving pulley 50 can be arranged such that its center 50*b* is positioned on the straight line α, i.e. on a line with the image bearing member pulley row of the image bearing member pulleys $\mathbf{20}a_Y$, $\mathbf{20}a_M$, $\mathbf{20}a_C$, $\mathbf{20}a_K$.

One endless image bearing member drive belt 53 is stretched over the image bearing member driving pulley 50 and image bearing member pulleys $\mathbf{20}a_Y$, $\mathbf{20}a_M$, $\mathbf{20}a_C$, $\mathbf{20}a_K$. The image bearing member drive belt 53 is to be rotatively driven clockwise as shown at the arrow in FIG. 2 by the image bearing member driving pulley 50. Namely, the moving direction of the belt portion 53*d*, as a tight-belt side of the image bearing member drive belt 53 and positioned closer to the intermediate transfer belt 16, is in a direction of oblique lower right, which is the same as the moving direction of the belt portion 16*a* of the intermediate transfer belt 16. Accordingly, the image bearing member driving pulley 50 is provided on the same side as the driving roller 14 for the intermediate transfer belt 16, with respect to a moving direction of the belt portions 16*a*, 53*d* of the both belts 16, 53.

Incidentally, the intermediate transfer belt 16 and the image bearing member drive belt 53 can be set inverse in their rotational directions. In such a case, as to the arrangement order of the image stations Y, M, C, K, the black image station B is provided in a position closest to the driving roller 14 and image bearing member driving pulley 50 while the yellow image station Y is provided in a position distant the most from the driving roller 14 and image bearing member driving pulley 50. The remaining magenta image station M and cyan image station C can be set arbitrary in arrangement order.

The image bearing members 20 for respective colors are arranged to be rotatively driven by the image bearing member drive belt 53, thus constituting the image forming apparatus 1 as a tandem belt-drive scheme. In this case, in the image forming apparatus 1 of this example, the moving speed (i.e. circumferential speed) at the belt portion 16*a* of the intermediate transfer belt 16 is set higher than a moving speed (i.e. circumferential speed) at the belt portion 53*d* of the image bearing member drive belt 53. Thus, a speed difference is set between the moving speeds of the both belts 16, 53. Incidentally, the speed difference of between the both belts 16, 53 can be set inverse.

Figure 4:
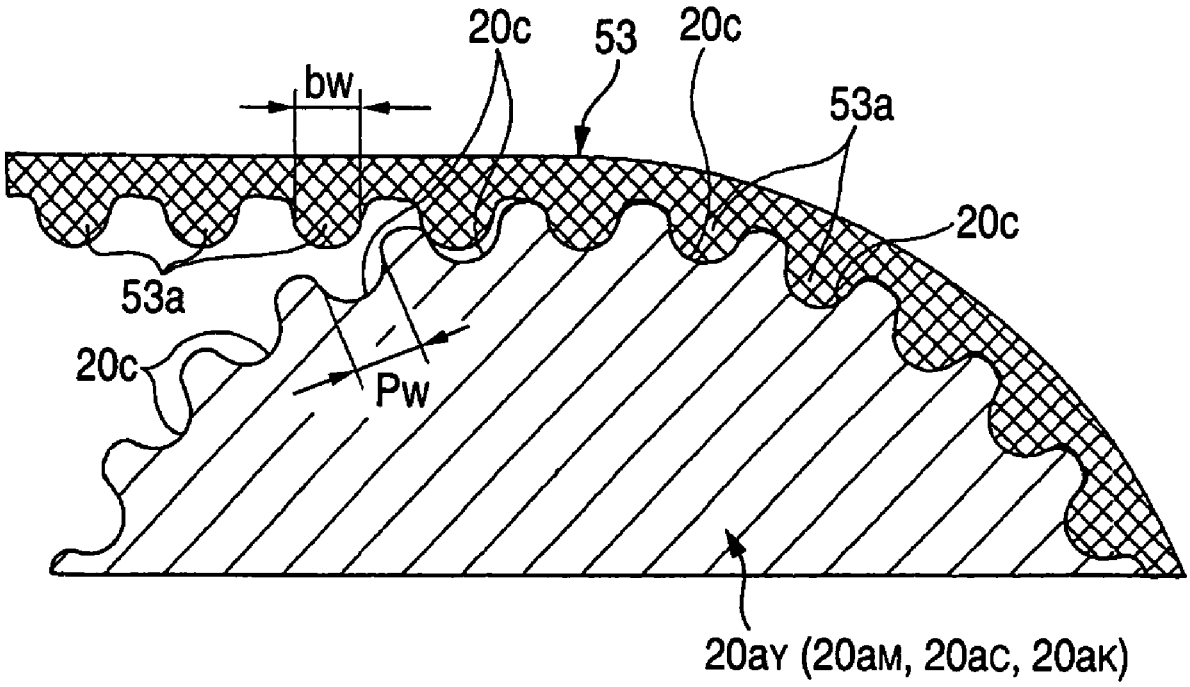
FIG. 4 is an explaining view showing a mesh between the grooves of the image bearing member pulley and the image bearing drive belt shown in FIG. 1.

As shown in FIG. 4, the image bearing member pulleys $\mathbf{20}a_Y$, $\mathbf{20}a_M$, $\mathbf{20}a_C$, $\mathbf{20}a_K$, are respectively formed as grooved pulleys each of which has a multiplicity of grooves 20*c* extending widthwise of the pulley. Meanwhile, although not shown, the image bearing member driving pulley 50 is also formed as a grooved pulley having a multiplicity of grooves 20*c* extending widthwise of the pulley. Furthermore, the image bearing member driving belt 53 is formed as a teethed belt (i.e. timing belt) having teeth 53*a* in mesh with the groves 20*c* of the image bearing member pulleys and the image bearing member driving pulley 50, respectively. Incidentally, the image bearing member drive belt 53 has an outer peripheral surface made as a flat surface.

By the meshing between the grooves of the pulleys $\mathbf{20}a_Y$, $\mathbf{20}a_M$, $\mathbf{20}a_C$, $\mathbf{20}a_K$, 50 and the teeth 53*a* of the image bearing member drive belt 53, no slip occurs between the pulleys $\mathbf{20}a_Y$, $\mathbf{20}a_M$, $\mathbf{20}a_C$, $\mathbf{20}a_K$, 50 and the image bearing member drive belt 53. Thus, positive power transmission is made possible at between the pulleys $\mathbf{20}a_Y$, $\mathbf{20}a_M$, $\mathbf{20}a_C$, $\mathbf{20}a_K$, 50 and the image bearing member drive belt 53. Due to this, even after a long term use, there is no possibility of a change in phase conditions on the pulleys $\mathbf{20}a_Y$, $\mathbf{20}a_M$, $\mathbf{20}a_C$, $\mathbf{20}a_K$ resulting from a slide between the pulleys 20$a_Y$, 20$a_M$, 20$a_C$, 20$a_K$, 50 and the image bearing member drive belt 53.

Meanwhile, setting is made to the same size on the size $p_W$ of the groove 20, of the image bearing member pulley 20$a_Y$, 20$a_M$, 20$a_C$, 20$a_K$ and the size $b_W$ of the tooth 53*a* of the image bearing member drive belt 53. Although not shown, the size of the groove of the image bearing member driving pulley 50 is also set the same as the size $b_W$ of the tooth 53*a* of the image bearing member drive belt 53. Accordingly, it is made possible to put the teeth 53*a* of the image bearing member drive belt 53 in mesh with the grooves of the pulleys 20$a_Y$, 20$a_M$, 20$a_C$, 20$a_K$, 50 with zero backlash, i.e. to put in meshing between the grooves of the pulleys 20$a_Y$, 20$a_M$, 20$a_C$, 20$a_K$, 50 and the teeth 53*a* of the image bearing member drive belt 53 into a mesh without leaving a gap in the rotational direction. This can prevent against the chatter on the pulleys 20$a_Y$, 20$a_M$, 20$a_C$, 20$a_K$, 50 resulting from torque variation or the like.

Furthermore, the image bearing member pulleys 20$a_Y$, 20$a_M$, 20$a_C$, 20$a_K$ of the image bearing members 20 are formed by use of the same mold die, and further the image bearing member pulleys 20$a_Y$, 20$a_M$, 20$a_C$, 20$a_K$ are assembled under a predetermined phase condition. Due to this, when the image bearing members 20 forms respective images to be superposed in the same position over the intermediate transfer belt 16, the rotational speed variation of the image bearing members 20 can be made the same speed variation. Accordingly, the respective colored images can be made same in expansion/contraction state, resultingly enabling to prevent against the color misalignment resulting from the image bearing member pulleys 20$a_Y$, 20$a_M$, 20$a_C$, 20$a_K$.

Figure 5:
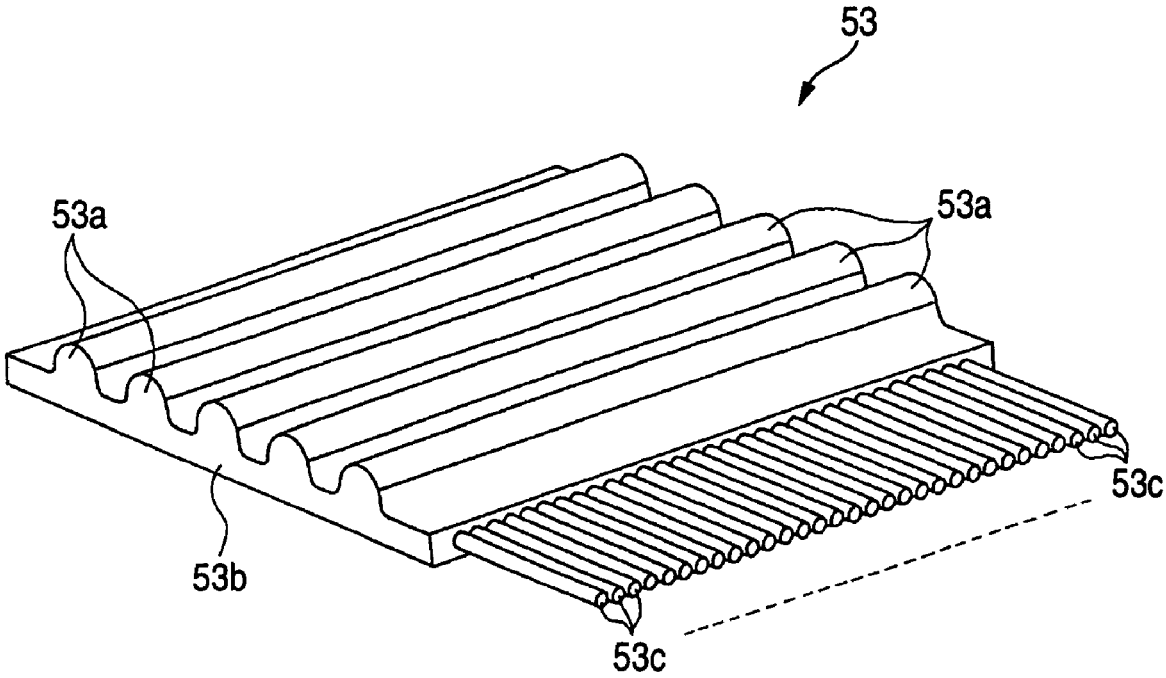
FIG. 5 is a view typically and partially showing the image bearing member drive belt shown in FIG. 1.

As shown in FIG. 5, the image bearing member drive belt 53 is structured with a belt main body 53*b* formed of rubber or the like and having teeth 53*a*, and a multiplicity of core members 53*c* formed, for example, of glass fiber or the like buried extending circumferentially and juxtaposed widthwise of the belt main body 53*b*. By virtue of the multiplicity of core members 53*c*, the image bearing member drive belt 53 can be prevented from expanding/contracting even where there is a variation in drive torque, thus enabling to stabilize belt driving. Moreover, because of the capability of preventing the image bearing member drive belt 53 from expanding/contracting, color misalignment also can be suppressed.

Idler pulleys 55, 56, 57 are respectively arranged between the image bearing member pulleys 20$a_Y$, 20$a_M$, 20$a_C$, 20$a_K$. By these idler pulleys 55, 56, 57, a predetermined number of meshes between the teeth 53*a* of the image bearing member drive belt 53 and the grooves 29*c* of the image bearing member pulleys 20$a_Y$, 20$a_M$, 20$a_C$, 20$a_K$ are secured, and furthermore a predetermined belt path is set. Meanwhile, the image bearing member drive belt 53 is urged a force F shown at the arrow by a tension pulley 54, the belt tension of which is regulated to a predetermined magnitude. This allows the image bearing member drive belt 53 to rotatively drive the image bearing member pulleys 20$a_Y$, 20$a_M$, 20$a_C$, 20$a_K$ positively and stably.

Figure 6:
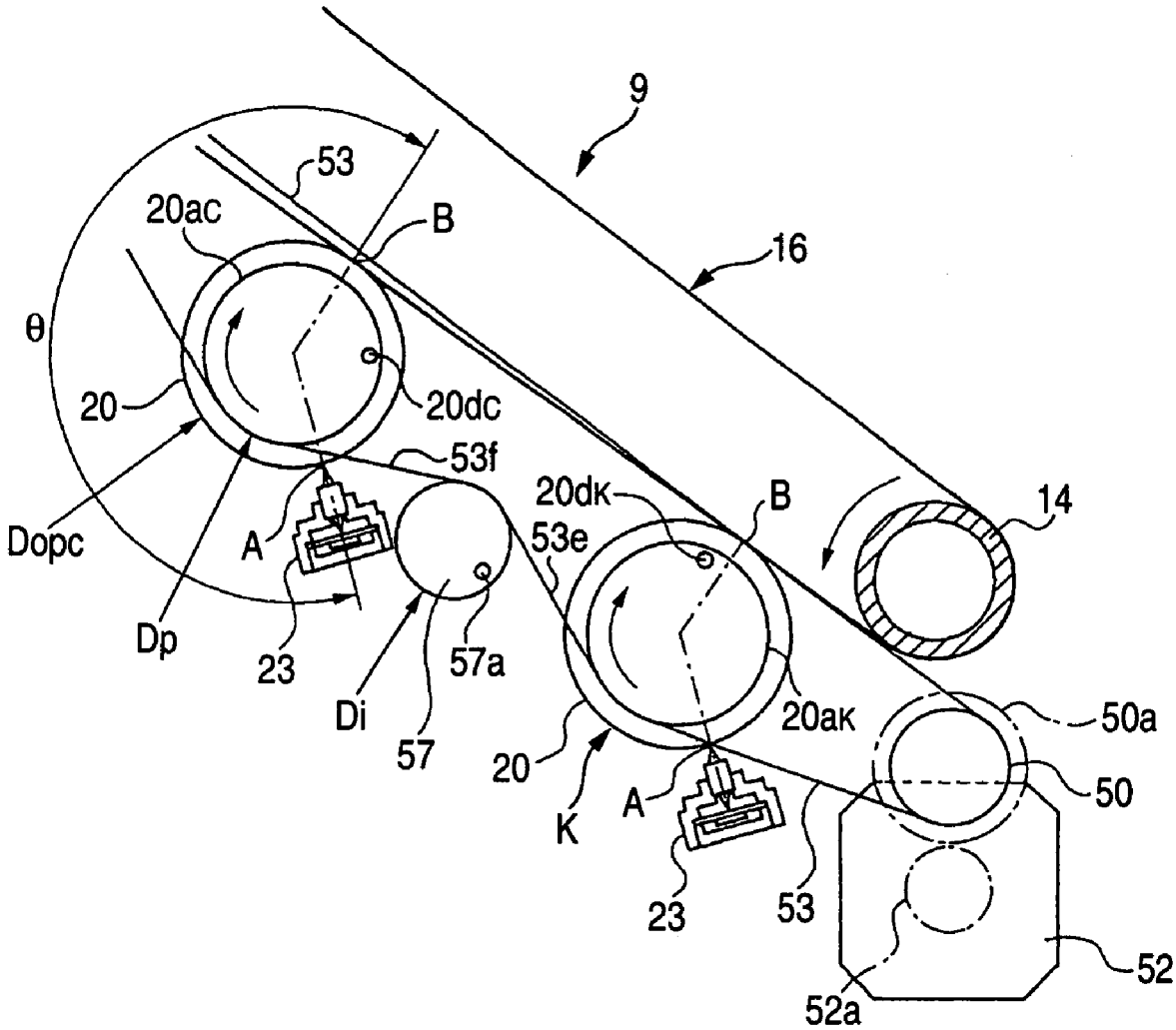
FIG. 6 is a partial magnifying view in FIG. 2.
Figure 7:
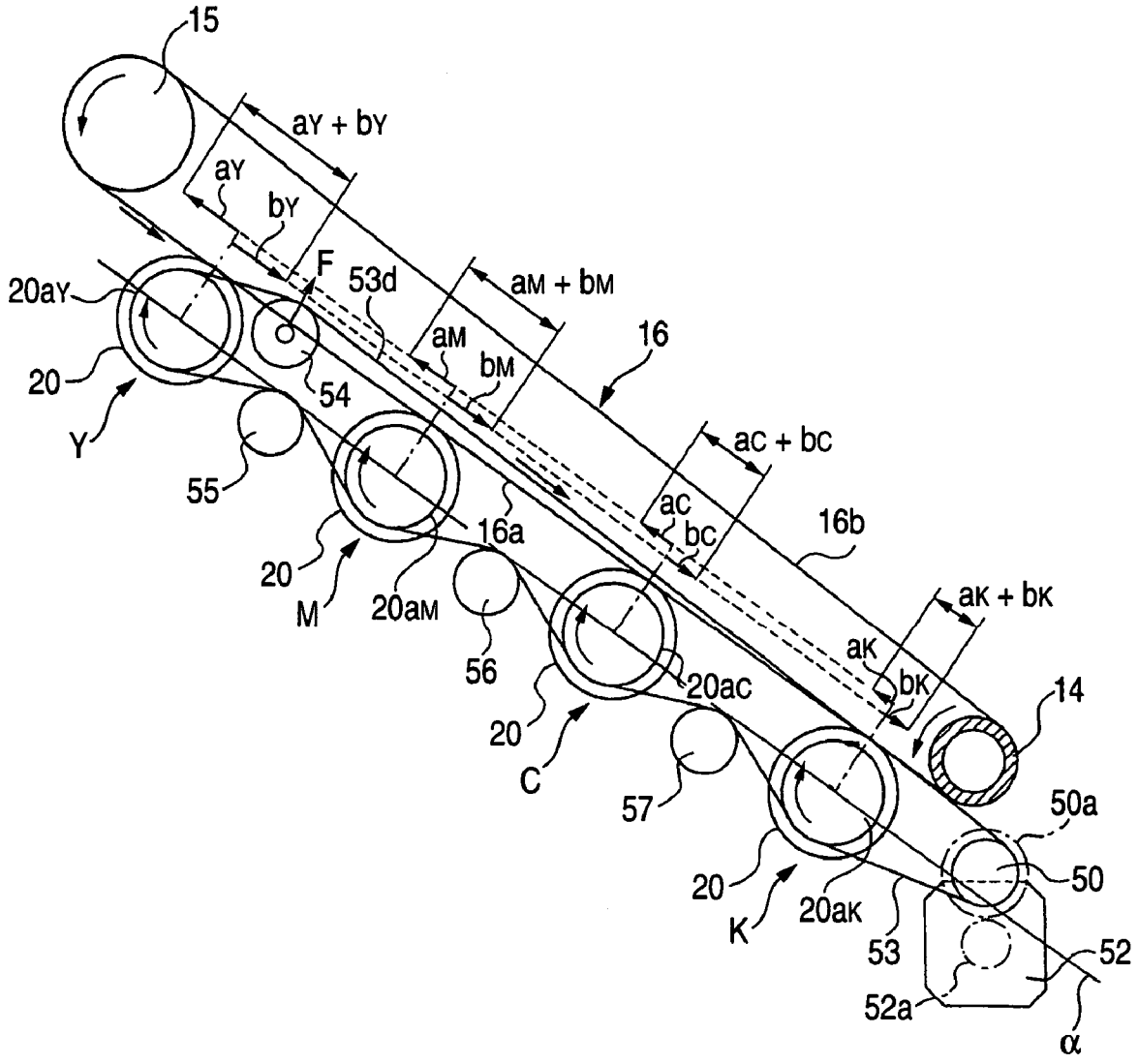
FIG. 7 is a view explaining a color misalignment due to elongations of the intermediate transfer belt and the image bearing member drive belt shown in FIG. 1.

Furthermore, in the image forming apparatus 1 of this embodiment, the rotation period of the idler pulley 57 arranged between the black (K) image bearing member 20 and the cyan (C) image bearing member 20 (time the idler pulley 57 rotates once, this can be applied to the other idler pulleys) is set at integer times of the time (image write-to-transfer time) when the cyan (C) image bearing member 20 positioned closer to the tension pulley 54 than the idler pulley 57 rotates from an image write position (exposure position for image write with radiation) A to a primary transfer position B, as shown in FIG. 6 for example. Meanwhile, although not shown similarly, the rotation period of the idler pulley 56 arranged between the cyan (C) image bearing member 20 and the magenta (M) image bearing member 20 is set at integer times (image write-to-transfer time) on the magenta (M) image bearing member 20 positioned closer to the tension pulley 54 than the idler pulley 56. Furthermore, the rotation period of the idler pulley 55 arranged between the magenta (M) image bearing member 20 and the yellow (Y) image bearing member 20 is set at integer times the (image write-to-transfer time) on the yellow (Y) image bearing member 20 positioned closer to the tension pulley 54 than the idler pulley 55.

Incidentally, in the image forming apparatus 1 of this embodiment, the image write-to-transfer time is set equal on all the respective colors (Y, M, C, K) of image bearing members 20, and rotation period is also set equal with all the idler pulleys 55, 56, 57. However, the image write-to-transfer time on the image bearing members 20 can be set different. Meanwhile, the rotation period on the idler pulleys 55, 56, 57 also can be set different.

Meanwhile, there is no need to provide idler pulleys all at the intermediate position of the four image bearing members 20, i.e. part of idler pulleys can be omitted. For example, when the idler pulley 56 between the cyan (C) image bearing member 20 and the magenta (M) image bearing member 20 is omitted, the rotation period of the idler pulley 57 between the black (K) image bearing member 20 and the cyan (C) image bearing member 20 is set at integer times the image write-to-transfer time on the two image bearing members 20 for cyan (C) and magenta (M) positioned closer to the tension pulley 54 (in this case, the integer times on the two image bearing members 20 can be set equal to each other or different from each other, this can be applied to the case with three image bearing members). Furthermore, where omitted is the idler pulley 55 between the magenta (M) image bearing member 20 and the yellow (Y) image bearing member 20, the rotation period of the idler pulley 57 is similarly set at integer times the (image write-to-transfer time) on the three image bearing members 20 for cyan (C), magenta (M) and yellow (Y) positioned closer to the tension pulley 54.

Furthermore, the idler pulley can be provided between the black (K) image bearing member 20 and the image bearing member driving pulley 50. In such a case, the rotation period of this idler pulley 57 is set at integer times the (image write-to-transfer time) on the black (K) image bearing member 20 positioned closer to the tension pulley 54.

Furthermore, in this image forming apparatus 1, phase match marks (corresponding to the image bearing member phase matching unit of the invention) 20*d* c, 20*d* K are provided respectively on the cyan (C) and black (K) image bearing members 20, as shown in FIG. 6. Although not shown, similar phase match marks are also provided respectively on the magenta (M) and yellow (Y) image bearing members 20. By adjusting the mesh point between the tooth 53*a* of the image bearing member drive belt 53 and the groove 20*c* of the image bearing member pulley 20$a_Y$, 20$a_M$, 20$a_C$, 20$a_K$ through use of such phase match marks, the phase conditions of the image bearing member pulleys 20$a_Y$, 20$a_M$, 20$a_C$, 20$a_K$ can be previously matched to the same, thus preventing against positional deviation between the respective colors of transfer images.

Furthermore, each of the idler pulleys 57 is also provided with a phase match mark (corresponding to the idler pulley phase matching unit of the invention). Although not shown, the other image bearing member idler pulleys 56, 57 are also provided with the similar phase match marks, respectively. By the capability of previously matching the phase conditions of the image bearing member pulleys 20$a_Y$, 20$a_M$, 20$a_C$, 20$a_K$ to the same through the use of the phase match marks, the image bearing member drive belt 53 is defined with a constant path thus preventing against positional deviations between the respective colors of transfer images.

In the image forming apparatus 1 of this example thus constructed, the image bearing member drive motor 52 upon image formation is driven to thereby rotatively drive the image bearing member driving pulley 50 clockwise in FIG. 2. By rotatively driving the image bearing member driving pulley 50, the image bearing member drive belt 53 rotates in the same clockwise direction shown at the arrow. Thereupon, because the image bearing member pulleys 20$a_Y$, 20$a_M$, 20$a_C$, 20$a_K$ are rotatively driven in the same clockwise direction shown by the arrow, the image bearing members also rotate in the same direction. Meanwhile, because the driving roller 14 is rotatively driven in the counterclockwise direction shown at the arrow, the intermediate transfer belt 16 is also rotated counterclockwise.

When the image bearing member drive belt 53 is rotated in this manner, the idler pulleys 55, 56, 57 rotate counterclockwise. At this time, in case there is an eccentricity on the idler pulleys 55, 56, 57 due to errors in geometry, fitness or the like as in the foregoing, the image bearing member drive belt 53 is changed in belt path thus causing a speed variation on the image bearing member drive belt 53. Namely, when the rotation radius of the idler pulley 57 increases in FIG. 6 by the eccentricity for example, the image bearing member drive belt 53 is pulled toward the intermediate transfer belt 16. Thereupon, although the belt portion 53*e* of image bearing member drive belt 53 on a side closer to the image bearing member driving pulley 50 less moves since the resistance by the image bearing member driving pulley 50 is exist, the belt portion 53*f* of image bearing member drive belt 53 on a side closer to the tension pulley 54 is intended to move toward the idler pulley 57. Consequently, the rotation speed of the cyan (C) image bearing member pulley 20$a_C$ is somewhat decreased. Meanwhile, when the rotation radius of the idler pulley 57 decreases due to an eccentricity, the image bearing member drive belt 53 is returned conversely to a side away from the intermediate transfer belt 16. Thereupon, the belt portion 53*f* of image bearing member drive belt 53 is to move toward the image bearing member pulley 20$a_C$. Due to this, the rotational speed of the image bearing member pulley 20 is somewhat increased. In this manner, by a reciprocal movement of the outer peripheral surface of idler pulley relative to the image bearing member drive belt 53 due to an eccentric rotation of the idler pulley 57, speed variation is caused in the rotation of the image bearing member drive belt 53 and cyan (C) image bearing member 20.

However, in the image forming apparatus 1 of this embodiment, the cyan (C) image bearing member 20 has an (image write-to-transfer time) integer times a rotation period of the idler pulley 57. Accordingly, when the image written in image write position A comes to a primary transfer position B, the idler pulley 57 rotates integer-number times. The phase of idler pulley 57 at that time is the same as the phase of idler pulley 57 upon writing the image at the image write position A. Accordingly, even in case there is a speed variation in rotation of the image bearing member drive belt 53 and cyan (C) image bearing member 20 during rotation of the cyan (C) image bearing member 20 from the image write position A to the primary transfer position B, the effect of the speed variation due to the idler pulley 57 is cancelled when the written image comes to the primary transfer position B. This prevents the positional deviation of the image on the cyan (C) image bearing member 20 positioned closer to the tension pulley 54 due to an eccentric rotation of the idler pulley 57. Likewise, in eccentric rotation of the idler pulley 55, 56 for other color, positional deviation is prevented of the image on the image bearing member 20 positioned closer to the tension pulley 54.

In this manner, according to the image forming apparatus 1 of this embodiment, it is possible to prevent against the positional deviation of an image on the image bearing member 20 positioned closer to the tension pulley due to an eccentric rotation of the idler pulley 57. Thus it is possible to obtain a quality color image free of color misalignment.

Further, since a plurality of image bearing members 20 are all rotated by one image bearing member drive belt 53 which is set with a belt path by the idler pulley 57 and given a predetermined tension by the tension pulley, the image bearing member drive system is simplified in construction and further the number of component parts can be reduced.

Now, an explanation is made on a concrete example of an image forming apparatus of the invention (see FIG. 6 for the references).

EXAMPLE 1

By the setting of a diameter $D_{OPC}$ of the image bearing member 20: ϕ24 mm, a rotation angle θ of the image bearing member 20 from the image write position A to the primary transfer position B: 240°, a pitch circle diameter $D_P$ of the groove portion in each image bearing member pulley: ϕ22.5 mm, a diameter Di of the idler pulley: ϕ15 mm, a rotation speed of each image bearing member: 125 rpm, and a rotation speed of the idler pulley: 187.5 rpm, we obtain the followings:

a time required for the image bearing member 20 to rotate from the image write position A to the primary transfer position B: 0.32 sec. and a rotation period of the idler pulley: 0.32 sec.

In the image forming apparatus 1 of this example 1, the image write-to-transfer time of the image bearing member 20 is one times the rotation period of the idler pulley.

EXAMPLE 2

By the setting of a diameter $D_{OPC}$ of the image bearing member 20: ϕ30 mm, a rotation angle θ of the image bearing member 20 from the image write position A to the primary transfer position B: 240°, a pitch circle diameter $D_P$ in the groove of the image bearing member pulley: ϕ24 mm, a diameter Di of the idler pulley: ϕ8 mm, a rotation speed of the image bearing member: 100 rpm, and a rotation speed of the idler pulley: 300 rpm, we obtain the followings:

a time required for the image bearing member 20 to rotate from the image write position A to the primary transfer position B: 0.4 sec. and a rotation period of the idler pulley: 0.2 sec.

In the image forming apparatus 1 of this embodiment 2, the image write-to-transfer time on the image bearing member 20 is two times the rotation period of the idler pulley.

In this manner, in both the image forming apparatuses 1 of examples 1 and 2, the image write-to-transfer time can be set integer times the rotation period of the idler pulley. This makes it possible to eliminate the positional deviation by canceling the effect of the speed variation over the image bearing member drive belt 53 and image bearing member 20 upon an image caused by an eccentric rotation of the idler pulley, in both the image forming apparatuses 1 of the examples 1 and 2. Therefore, both the image forming apparatuses 1 of the examples 1 and 2 can obtain a full-color image free of misalignment of colors and higher in quality.

Incidentally, although the foregoing examples made the explanation by applying the image forming apparatus 1 of the invention to the image forming apparatus having four different colors, i.e. yellow (Y), magenta (M), cyan (C) and black (K), of image bearing members, the present invention is not limited to this but can be applied to an image forming apparatus 1 having two or more of a plurality of image bearing members.

Meanwhile, although the foregoing examples made the explanation by applying the invention to the image forming apparatus having the intermediate transfer belt, the invention can be applied also to an image forming apparatus not having an intermediate transfer belt.

Furthermore, in the foregoing example, the image bearing member drive belt 53 is made a U-turn at the yellow (Y) image bearing member pulley 20$a_Y$ wherein there is no provision of an image bearing member driven pulley to be rotatively driven by the image bearing member drive belt 53. However, the invention can provide an image bearing member driven pulley in the forward of the image bearing member pulley 20*a*Y so that the image bearing member drive belt 53 can be made a U-turn by the image bearing member driven pulley.

Next, a second embodiment of the invention will be explained. As shown in FIGS. 2 and 3, the image bearing member driving pulley 50 is arranged on a side closer to the driving roller 14 for the intermediate transfer belt 16. The image bearing member 20 for black (K) is provided in a position closest to the driving roller 14 and image bearing member driving pulley 50 while the image bearing member 20 for a less visible color, yellow (Y), is provided in a position the most distant from the driving roller 14 and image bearing member driving pulley 50.

Further, in the image forming apparatus 1 of this embodiment, concerning the arrangement order of the image stations Y, M, C, K, as long as the image station B for black is provided in a position closest to the driving roller 14 and image bearing member driving pulley 50 while the image station Y for a less visible color, yellow, is provided in a position the most distant from the driving roller 14 and image bearing member driving pulley 50, the remaining image station M for magenta and image station C for cyan may be inverse in arrangement order.

Incidentally, the intermediate transfer belt 16 and the image bearing member drive belt 53 can be set inverse in their rotational directions. In such a case, as to the arrangement order of the image stations Y, M, C, K, the black image station B is provided in a position closest to the driving roller 14 and image bearing member driving pulley 50 while the yellow image station Y for a less visible color, yellow, is provided in a position distant the most from the driving roller 14 and image bearing member driving pulley 50. The remaining magenta image station M and cyan image station C can be set arbitrary in arrangement order.

Figure 11:
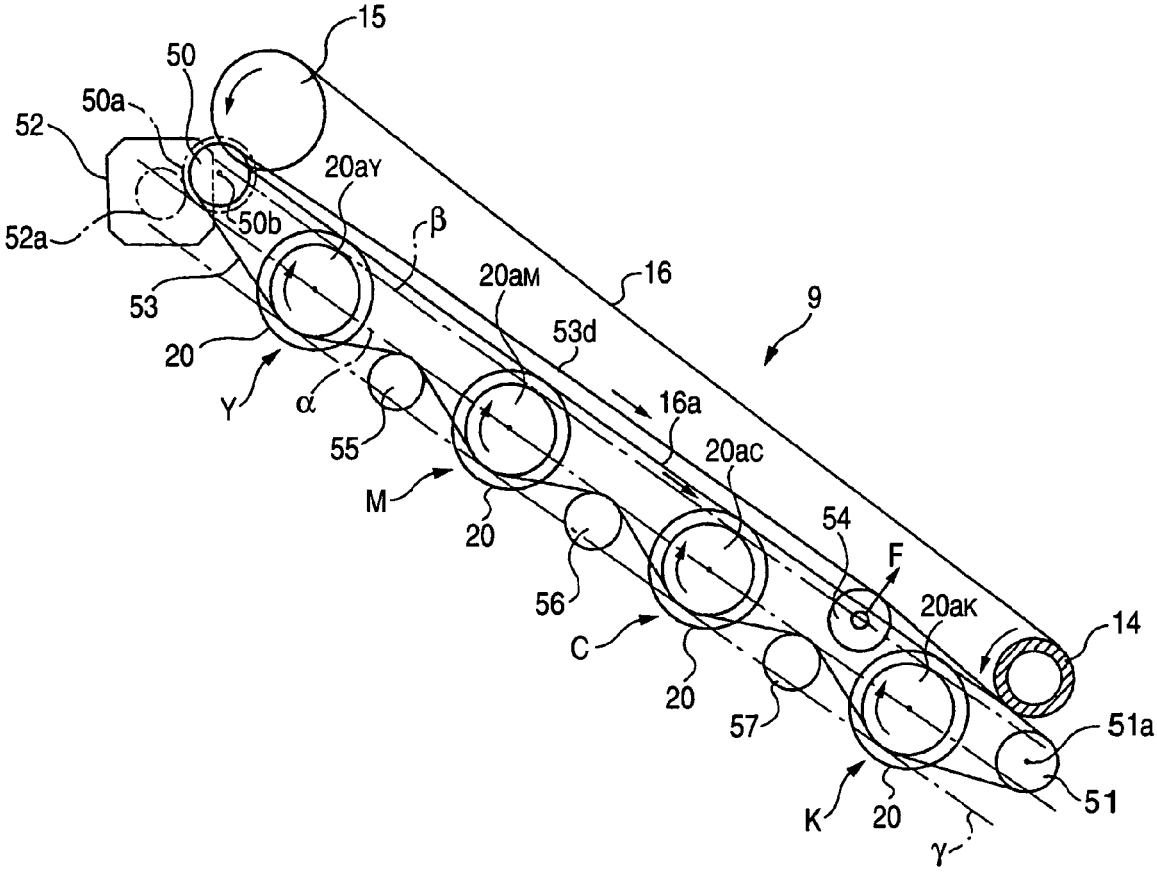
FIG. 11 is a view typically showing an intermediate transfer belt and the image bearing member drive belt shown in FIG. 1.

As shown in FIG. 5, the image bearing member drive motor 52 is driven upon forming an image, to rotatively drive the image bearing member driving pulley 50 clockwise in FIG. 11. By rotatively driving the image bearing member drive pulley 50, the image bearing member drive belt 53 is rotated similarly clockwise as shown by the arrow. Thereupon, because the image bearing member pulleys 20$a_Y$, 20$a_M$, 20$a_C$, 20$a_K$ are also rotatively driven similarly clockwise as shown by the arrow, the image bearing members 20 are rotated together in the same direction. Meanwhile, because the driving roller 14 is rotatively driven counterclockwise as shown by the arrow, the intermediate transfer belt 16 is also rotated counterclockwise.

When the intermediate transfer belt 16 and image bearing member drive belt 53 rotates in this manner, a certain degrees of elongation occurs on each of the intermediate transfer belt 16 and the image bearing member drive belt 53 despite the core member 53*c* suppresses against the elongation of the image bearing member drive belt 53. The elongation of the belt 16, 53 gives rise to a color misalignment in the primary transfer images in respective colors to be primarily transferred onto the belt portion 16*a*.

Figure 13:
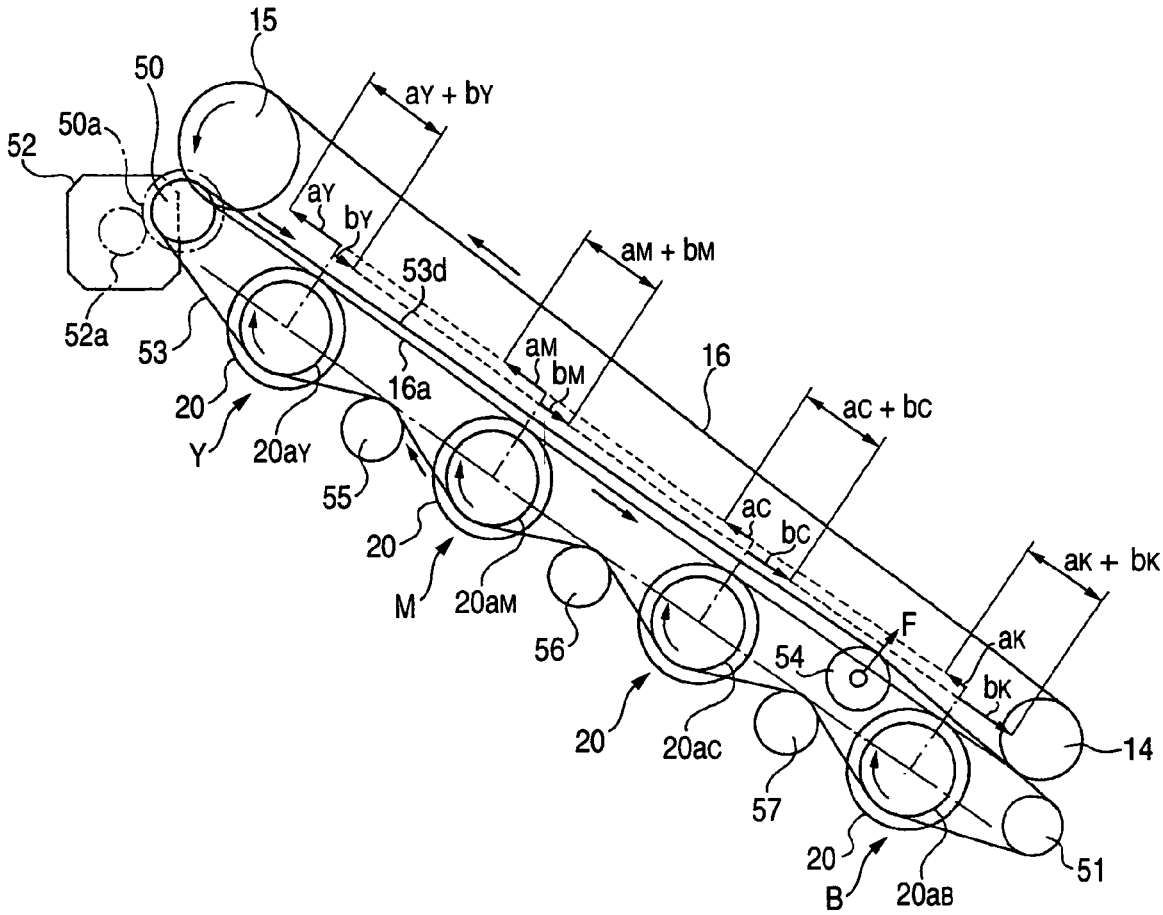
FIG. 13 is a view explaining a color misalignment due to elongations of the intermediate transfer belt and the image bearing member drive belt shown in FIG. 1.

As shown in FIG. 13, of the color misalignments, as to the color misalignment resulting from an elongation of the intermediate transfer belt 16, color misalignment is minimal on the black (K) closest to the driving roller 14. Color misalignment increases due to integration as going distant from the driving roller 14, thus attaining the maximal color misalignment on the yellow (Y) the most distant from the driving roller 14. Namely, for color misalignment due to an elongation of the intermediate transfer belt 16, provided that the color misalignment amounts of black (K), cyan (C), magenta (M) and yellow (Y) are $a_K$, $a_C$, $a_M$ and $a_Y$, then the following results.

$$a_K<a_C,\ a_M<a_Y \tag{1}$$

Meanwhile, as for the color misalignment resulting from an elongation of the image bearing member driving belt 53, color misalignment is the minimal at the black (K) closest to the image bearing member driven pulley 50. The color misalignment increases with integration as going distant from the image bearing member drive pulley 50, thus attaining the maximal color misalignment at the yellow (B) the most distant from the image bearing member driving pulley 50. Namely, for color misalignment due to an elongation of the image bearing member drive belt 53, provided that the amounts of color misalignment as to yellow (Y), magenta (M), cyan (C) and black (K) are $b_K$, $b_C$, $b_M$ and $b_Y$, then the following results.

$$b_K<b_C,\ b_M<b_Y \tag{2}$$

Accordingly, the aggregated amounts of color misalignment as to black (K), cyan (c), magenta (M) and yellow (Y) are respectively $a_K+b_K$, $a_C+b_C$, $a_M+b_M$ and $a_Y+b_Y$. However, from the relationship between the foregoing expressions (1) and (2), the aggregated amounts of color misalignment are as given by the following.

$$a_K+b_K<a_C+b_C<a_M+b_M<a_Y+b_Y \tag{3}$$

As apparent from the inequalty (3), the both belts 16, 53 have color misalignment amounts resulting from the respective elongations that color misalignment amount is minimal on black (K). The color misalignment amount on cyan (C) and the color misalignment amount on magenta (M) are greater in this order. The color misalignment amount on yellow (Y) is the greatest. Accordingly, color misalignment amount is the minimal on the black (K) visible the most while color misalignment amount is the maximal on yellow less visible. Due to this, for the toner images to be respectively transferred onto the intermediate transfer belt 16, there is less effect of black (K) color misalignment in a visual sense. Meanwhile, the effect of yellow (Y) color misalignment is lowered.

In this manner, according to the image forming apparatus 1 of this example, because the image bearing member driving pulley 50 is provided on the same side as the driving roller 14 for the intermediate transfer belt 16 with respect to a moving direction of the belt portion 16*a* of intermediate transfer belt 16 opposed to the image bearing members 20 and the belt portion 53*d* of image bearing member driving belt 53 closer to the intermediate transfer belt 16. Furthermore, the black (K) image bearing member well visible is provided in a position closest to the driving roller 14 and image bearing member driving pulley 50 while the yellow (Y) image bearing member less visible is provided in a position distant the most from the driving roller 14 and image bearing member driving pulley 50. Accordingly, even where a misalignment of colors occurs resulting from the elongations of the intermediate transfer belt 16 and image bearing member driving belt 53, the effect of color misalignment can be effectively reduced in respect of visual sense. It is possible to obtain a quality full-color image can be obtained in visual sense.

Further, because the image bearing member driving pulley 50 is arranged nearly on a line or on a line with the image bearing member pulley rows of the image bearing member pulleys $\mathbf{20}a_Y$, $\mathbf{20}a_M$, $\mathbf{20}a_C$, $\mathbf{20}a_K$, the image bearing member drive belt 53 can be shortened in belt length. Because this can reduce the elongation of the image bearing member driving belt 53, the color misalignment due to belt elongation can be suppressed further effectively. Moreover, there is no possibility that the image bearing member driving pulley 50 goes distant greatly in a direction orthogonal to the image bearing member pulley row from the image bearing member pulley row of the image bearing member pulleys $\mathbf{20}a_Y$, $\mathbf{20}a_M$, $\mathbf{20}a_C$, $\mathbf{20}a_K$. Thus, there is eliminated a need of a large arrangement space, making it possible to improve compactness.

Incidentally, the foregoing examples explained the image forming apparatus of the invention by applying it to the image forming apparatus 1 having four different colors, i.e. yellow (Y), magenta (M), cyan (C) and black (K), of image bearing members. However, the invention is not limited to this but can be applied to an image forming apparatus 1 having a plurality of image bearing members for black (K) and one or more colors except for black (K). In such a case, when the image forming apparatus 1 has a plurality of image bearing members for colors other than black (K), the image bearing member for the least visible color of among the plurality of colors other than black (K) is satisfactorily arranged in a position the most distant from the image bearing member driving pulley 50.

Furthermore, in the foregoing example, although the image bearing member drive belt 53 is made a U-turn at the yellow (Y) image bearing member pulley 20*a*Y thereby omitting the provision of an image bearing member driven pulley to be rotatively driven by the image bearing member drive belt 53, the invention can provide an image bearing member driven pulley in the forward of the image bearing member pulley $\mathbf{20}a_Y$ so that the image bearing member drive belt 53 is made a U-turn at the image bearing member driven pulley.

Next, a third embodiment of the invention will be explained with reference to FIGS. 8 to 10. In this embodiment, a registration control is carried out to correct the color misalignment. The same components as the first and second embodiments are given the same signs and numerals and corresponding description is omitted.

As explained in the second embodiment, the intermediate belt 16 and the image bearing body drive belt 53 has some elongated portion. Consequently, the elongation of the belt 16, 53 cause the color misalignment in the primary transfer images in respective colors to be primarily transferred onto the belt portion 16*a*. Therefore, the aggregated amounts of color misalignment are as given by the expression (3).

In the image forming apparatus 1 of this embodiment, the registration control is similarly to the image forming apparatus disclosed in JP-A-2003-280313. Because the detail of the color-misalignment correction based on registration control is to be understood by making a reference to JP-A-2003-280313, brief explanation is herein made on the matter related to the invention. Note that, although the term of registration control is not used in JP-A-2003-280313, color-misalignment correction based on registration control refers to such color-misalignment correction as disclosed in JP-A-2003-280313.

In the image forming apparatus disclosed in JP-A-2003-280313, the factors of color misalignment as a subject of color-misalignment correction include the accuracy in support position (orthogonal position to the shaft 20*b*K, 20*b*C, 20*b*M, inclination of the shaft 20*b*K, 20*b*C, 20*b*M, etc.) of the shaft 20*b*K, 20*b*C, 20*b*M of the image bearing members 20 supported by the image bearing member support member 2*a* attached on the housing main body 2 (accuracy in relative position of the image bearing members 20), accuracy in diameter of each image bearing member (K, C, M, Y), working accuracy of the shafts 20*b*K, 20*b*C, 20*b*M, and so on.

In order to correct for color misalignment based on such factors, a positioning pin is provided on the image bearing member support member 2*a* supporting the image bearing members 20. The image bearing member support member 2*a* is positioned in a predetermined position (reference position) defined in the housing main body 2 by the positioning pin, thereby unambiguously aligning the relative positions of the image bearing members 20 (K, C, M, Y) supported by the image bearing member support member 2*a*.

In the image forming apparatus 1 of this embodiment, the positioning pin is constituted by the shaft 20*b*K of the black (K) image bearing member 20 arranged closest to the image bearing member driving pulley 50. In the color misalignment correction based on registration control, black (K) is the reference color in correction. As shown in FIG. 3, the shaft 20*b*K has an extension 20*b*K1 set with an axial length longer than the axial length of the other colors of shafts 20*b*C, 20*b*M, 20*b*Y. By the extension 20*b*K1, the image bearing member support member 2*a* is positioned in a predetermined position (reference position) in the housing main body 2. Accordingly, concerning color misalignment information, when the other image bearing member 20 than black (K) as reference color is in positional deviation from the normal position previously established based on the reference position of the black (K) image bearing member 20, color misalignment information relative to black (K) as reference color is obtained that is caused by a positional deviation of that image bearing member 20.

During product shipment for example, determination is made as to whether or not there is an occurrence of color misalignment on the relevant product by a comparison between a normal pattern and a test pattern, thus acquiring color misalignment information on the basis of a position of the image bearing members 20.

An electronic module 60 as storage means is provided on a side plate of the image bearing member support member 2*a*. The electronic module 60 stores manufacture information about the image bearing members 20, use condition information, color misalignment information acquired as in the above, and so on. The electronic module 60 is constituted by an IC.

Figure 8:
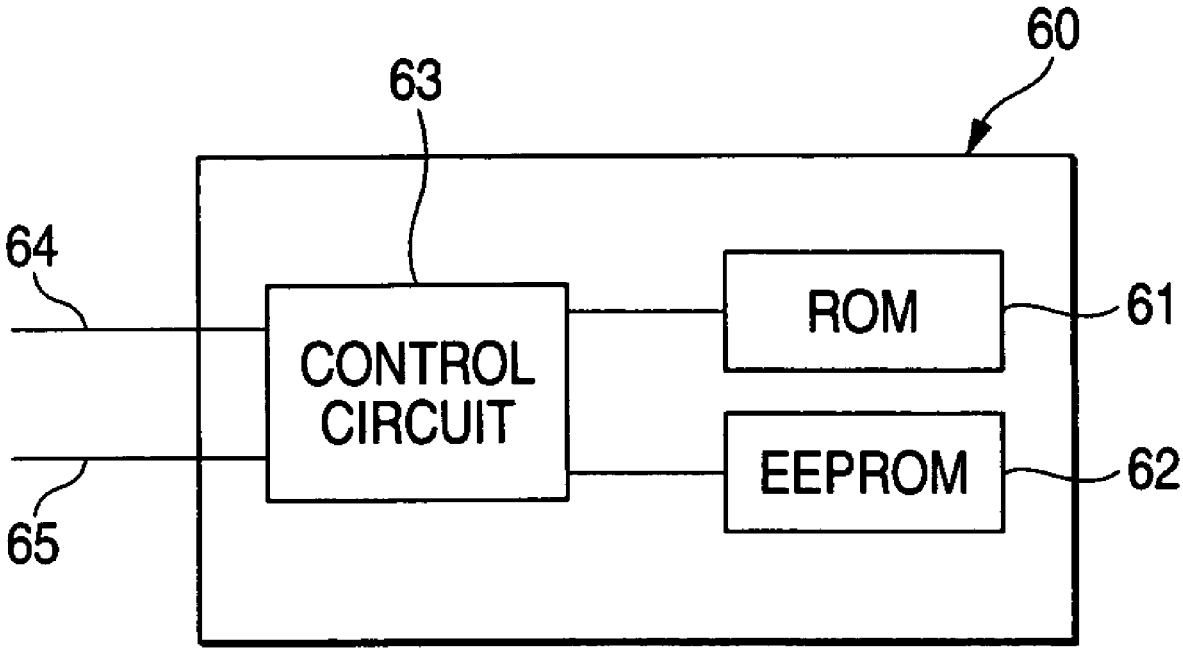
FIG. 8 is a block diagram showing a configuration example of an electronic module for correcting a color misalignment of the image forming apparatus shown in FIG. 1.

FIG. 8 is a block diagram showing a configuration example of the electronic module 60 attached on the image bearing member support member 2*a*.

As shown in FIG. 8, the electronic module 60 has a ROM 61 storing unique information including serial number, manufacture date, etc. of the apparatus concerned, an EEPROM 62 storing information about color misalignment, rotational speed of the image bearing members 20, etc., and a control circuit 63 for controlling these ROM 61 and EEPROM 62. The control circuit 63 is connected with two cables of a signal/power supply line 64 and a ground line (GND) 65. Meanwhile, EEPROM 62 is an electrically erasable program ROM capable of reading and writing.

Figure 9:
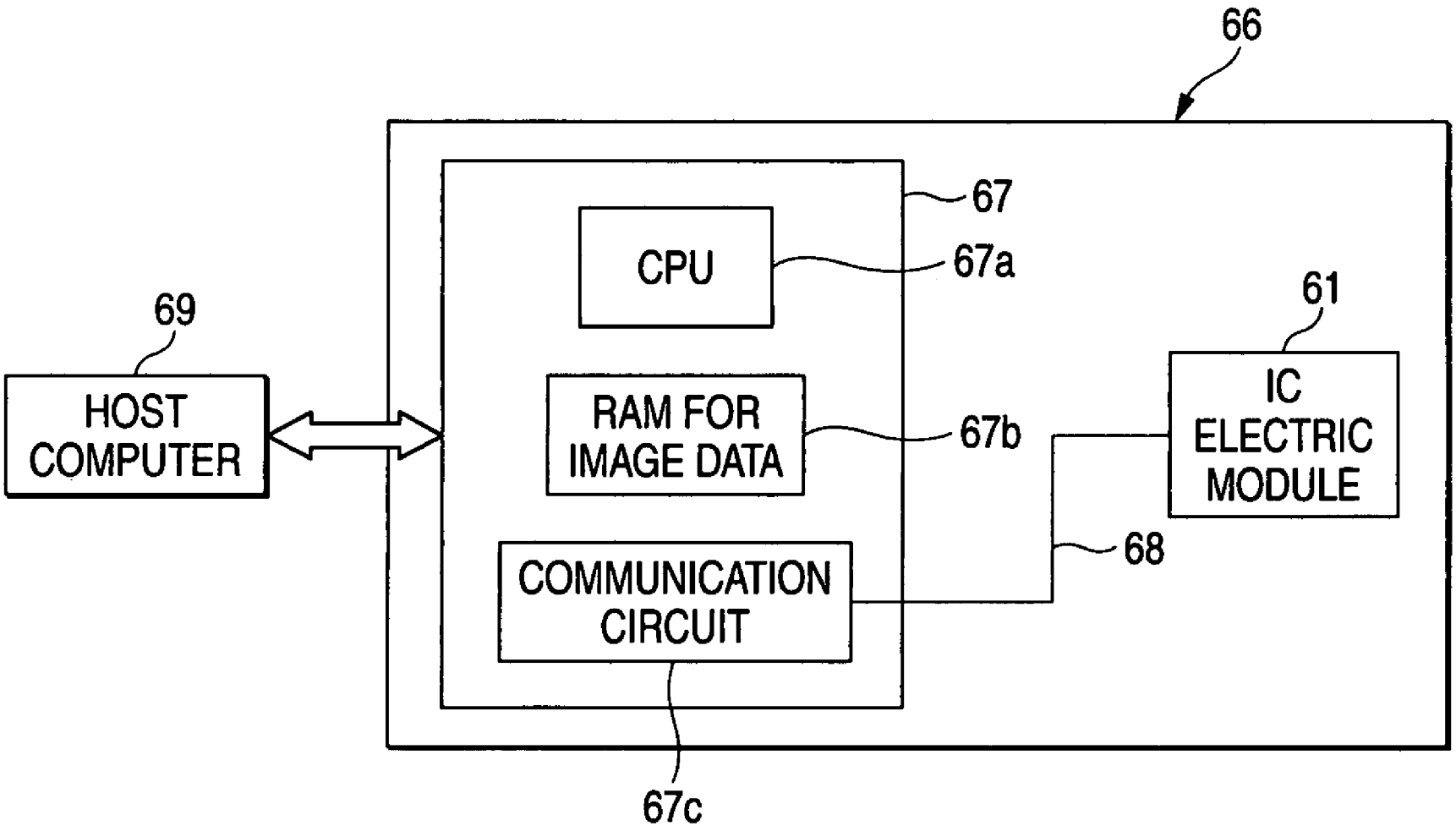
FIG. 9 is a block diagram showing a control section for correcting the color misalignment of the image forming apparatus shown in FIG. 1.

FIG. 9 is a block diagram showing an example of the control section 66 for correcting the image forming apparatus 1 for color misalignment depending upon the color misalignment information stored in the electronic module 60.

As shown in FIG. 9, the control section 66 is provided with a controller 67 functioning as color-alignment correcting means. The controller 67 has a CPU (central processing unit) 67*a*, a RAM 67*b* for image data, and a communication circuit 67.

The color misalignment information stored in the EEPROM 62 of the electronic module 60 is sent to the communication circuit 67*c* by a signal line 68 through the control circuit 63. The color misalignment information received by the communication circuit 67*c* is conveyed to the CPU 67*a*. The CPU 67*a* corrects the image data stored in the image data RAM 67*b*, based on a predetermined signal according to a content of the color misalignment information, thus correcting for color misalignment.

The control section 66 is connected to a host computer 69. By a signal from the host computer 69, a control program is started up to correct for color misalignment. Meanwhile, information such as color-misalignment correcting data is sent to the host computer 69. The host computer 69 can store color-misalignment data of the image forming apparatus 1. At the end of the host computer 69, image processing for color-misalignment correction is made depending upon the sent color-misalignment correcting data, and sends printing data correction-processed to the controller 67. The controller 67 controls the write means 23 depending upon the printing data, thus carrying out a printing.

Figure 10:
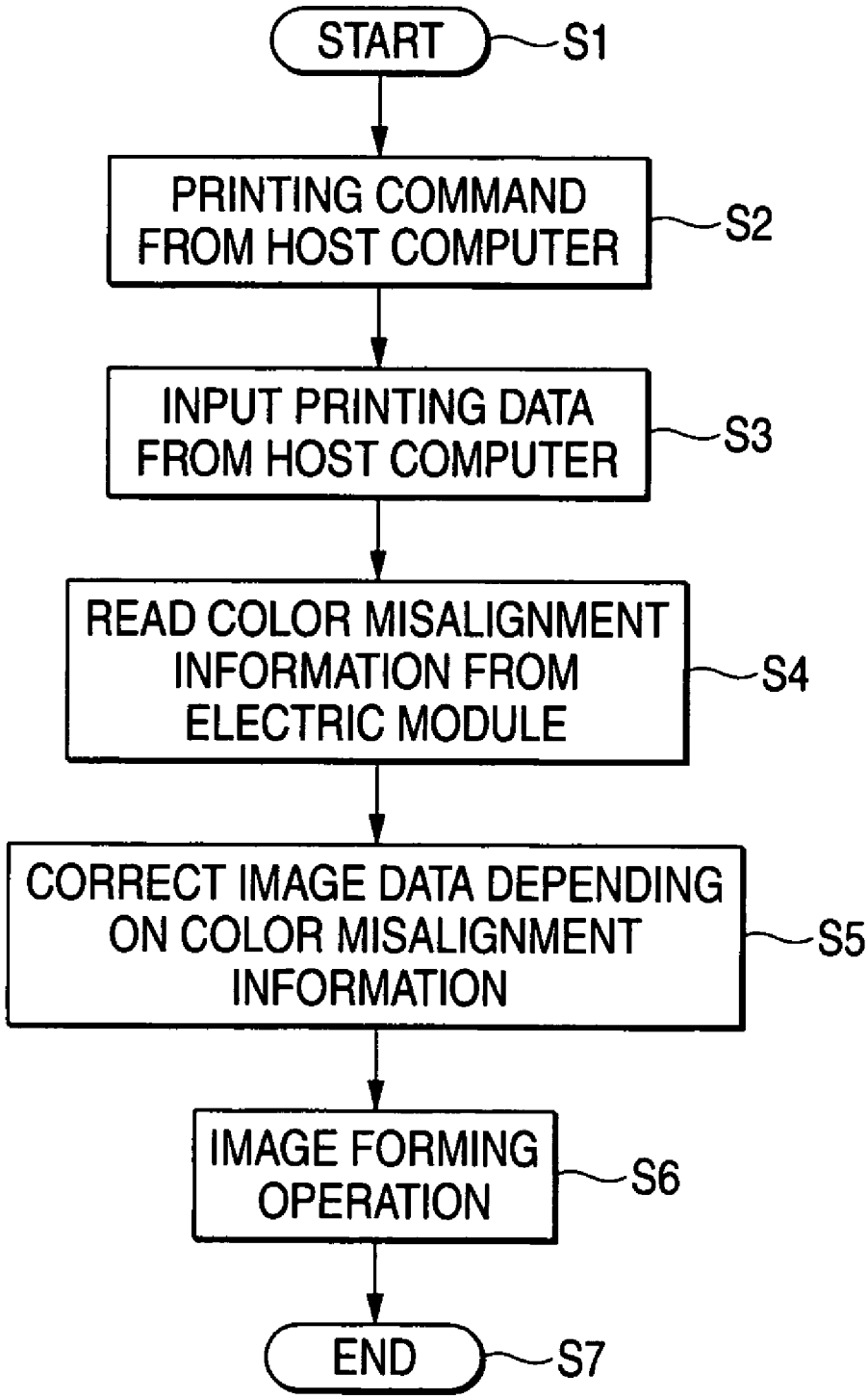
FIG. 10 is a flowchart showing a procedure for correcting the color misalignment by a control section of the image forming apparatus shown in FIG. 1.

FIG. 10 is a flowchart showing a process procedure of such color-misalignment correction.

As shown in FIG. 10, when a color-misalignment correction processing program is started up at step Si by the control section 66 in order to carry out color-misalignment correction, a printing command is issued at step S2 from the host computer 69. The print command is received by the controller 67 of the control section 66. Subsequently, at step S3, printing data is inputted to the controller 67 from the host computer 69.

Then, at step S4, the CPU 67*a* of the controller 67 reads color-misalignment information out of the electronic module 60. At step S5, the color-misalignment information and the image data stored in the image-data RAM 67*b* are sent to the host computer 69. The host computer 69 makes a color-misalignment correction on the image data depending upon the color-misalignment information. Then, at step S6, the image data corrected for color misalignment is sent to the controller 67. After the controller 67 makes an image forming operation depending upon the image data, the color-misalignment correction processing program is ended at step S7.

The other configuration concerned with color-misalignment correction in the image forming apparatus 1 of this example is the same as the configuration concerned with color-misalignment correction in the image forming apparatus 1 disclosed in JP-A-2003-280313.

More specifically, the positioning pin on the image bearing member support member 2*a* is configured by the shaft 20*b*K of the black (K) image bearing member 20 which are positioned closest to the image bearing member driving pulley. Black (K) minimal in color misalignment amount as a reference color in color-misalignment correction is based on registration control, thereby, the amount of color-misalignment correction is made further suitable for the respective colors. This reduces the effect of a misalignment of colors resulting from the elongations of the both belts 16, 53, in the toner images to be respectively transferred to the intermediate transfer belt 16.

In this manner, according to the image forming apparatus 1 of this embodiment, color misalignment can be corrected which results from the accuracy in relative position of the image bearing members 20, the accuracy in diameter of the image bearing members 20 and the working accuracy of the shafts 20*bk*, 20*b*C, 20*b*M, 20*b*Y of the image bearing members 20, similarly to the image forming apparatus 1 disclosed in JP-A-2003-280313.

Moreover, the image bearing member driving pulley 50 is provided on the same side as the driving roller 14 for the intermediate transfer belt 16 with respect to a moving direction of the belt portion 16*a* of intermediate transfer belt 16 opposed to the image bearing members 20 and the belt portion 53*d* of image bearing member drive belt 53 closer to the intermediate transfer belt 16. Furthermore, the black (K) positioned closest to the image bearing member driving pulley and minimal in color misalignment amount is taken as a reference color in color misalignment correction based on registration control. Accordingly, should a misalignment of colors occur resulting from an elongation of the intermediate transfer belt 16 and an elongation of the image bearing member drive belt 53, it is possible to suppress minimal the effect of color misalignment to the minimum and hence to obtain an quality full-color image.

Meanwhile, because the image bearing member driving pulley 50 is arranged nearly on a line or on a line with the image bearing member pulley row of the image bearing member pulleys 20*a*Y, 20*a*M, 20*a*C, 20*a*K, the image bearing member drive belt 53 can be shortened in belt length. This can reduce the elongation of the image bearing member drive belt 53, hence further effectively suppressing the color misalignment due to belt elongation. Moreover, there is no possibility that the image bearing member driving pulley 50 goes distant greatly from the image bearing member pulley row of the image bearing member pulleys 20*a*Y, 20*a*M, 20*a*C, 20*a*K in a direction orthogonal to the image bearing member pulley row. Thus, there is eliminated a need of a large arrangement space, making it possible to improve compactness.

Further, because the four image bearing members 20 are relatively positioned in position and rotatably supported on the image bearing member support member 2*e*, the four image bearing members 20 can be easily attached on the housing main body 2 while improving the accuracy of mutual alignment thereof.

Further, because the shaft 20*b*K of the black (K) image bearing member 20 provided in a closest position to the image bearing member driving pulley 50 is used also as a positioning pin wherein the black (K) on this image bearing member is taken as a reference color in color-misalignment correction based on registration control, an exclusive positioning pin is made unnecessary. Accordingly, the number of component parts can be reduced to lower manufacture cost.

Incidentally, in the image forming apparatus 1 in this embodiment, explanation was made to carry out a color-misalignment correction based on registration control as disclosed in JP-A-2003-280313, the present invention is not limited to that, e.g. application is possible to a correction for positional misalignment between a plurality of images by use of a register mark disclosed in JP-B-2603254.

Meanwhile, in the image forming apparatus 1 of the foregoing example, the four image bearing members 20 were supported by one image bearing member support member 2*a* in an integral fashion, the invention is not limited to that, i.e. application is possible to an image forming apparatus 1 having four image bearing members 20 separately provided on the housing main body 2*a* or the like.

Furthermore, in the image forming apparatus 1 of the foregoing example, the shaft 20*b*K of the black (K) image bearing member 20 provided in a closest position to the image bearing member driving pulley 50 was used as a positioning pin for the image bearing member support member 2*a* relative to the housing main body 2. However, there is not necessarily a need to use the shaft of the image bearing member 20. An exclusive positioning pin may be provided in a closest position of the image bearing member support member 2*a* to the image bearing member driving pulley 50.

Furthermore, in the image forming apparatus 1 of the foregoing example, the black image station B was provided in a closest position to the image bearing member driving pulley 50, to provide C, M and Y of image stations in the order of going distant from the image bearing member driving pulley 50. However, the arrangement order of the image bearing members 20 is not limited to that but can be set up arbitrarily. In such a case, the color concerning the image bearing member 20 provided in the closest position to the image bearing member driving pulley 50 is satisfactorily taken as a reference color in color-misalignment correction based on registration control.

Furthermore, rotational direction can be set inverse for the intermediate transfer belt 16 and the image bearing member drive belt 53. In such a case, the arrangement order of the image bearing members 20 is not limited to that but can be set up arbitrarily. Likewise, the color concerning the image bearing member 20 provided in the closest position to the image bearing member driving pulley 50 is satisfactorily taken as a reference color in color-misalignment correction based on registration control.

Furthermore, in the foregoing example, the image forming apparatus of the invention was explained by applying the image forming apparatus 1 of the invention to the image forming apparatus having four different colors, i.e. yellow (Y), magenta (M), cyan (C) and black (K), of image bearing members. However, the present invention is not limited to that but can be applied to an image forming apparatus 1 having two or more of a plurality of image bearing members besides to an image forming apparatus 1 having at least three different colors, i.e. yellow (Y), magenta (M) and cyan (C), to be rotatively driven by one image bearing member drive belt.

Furthermore, in the foregoing example, the image bearing member drive belt 53 was made a U-turn at the yellow (Y) image bearing member pulley 20*a*Y to thereby eliminate the provision of an image bearing member driven pulley to be rotatively driven by the image bearing member drive belt 53. However, the invention can provide an image bearing member driven pulley in the forward of the image bearing member pulley 20*a*Y so that the image bearing member drive belt 53 can be made a U-turn by the image bearing member driven pulley.

Next, a fourth embodiment of the invention will be explained with reference to FIGS. 11 to 14. The same components as the first and second embodiments are given the same signs and numerals and corresponding description is omitted.

Figure 12:
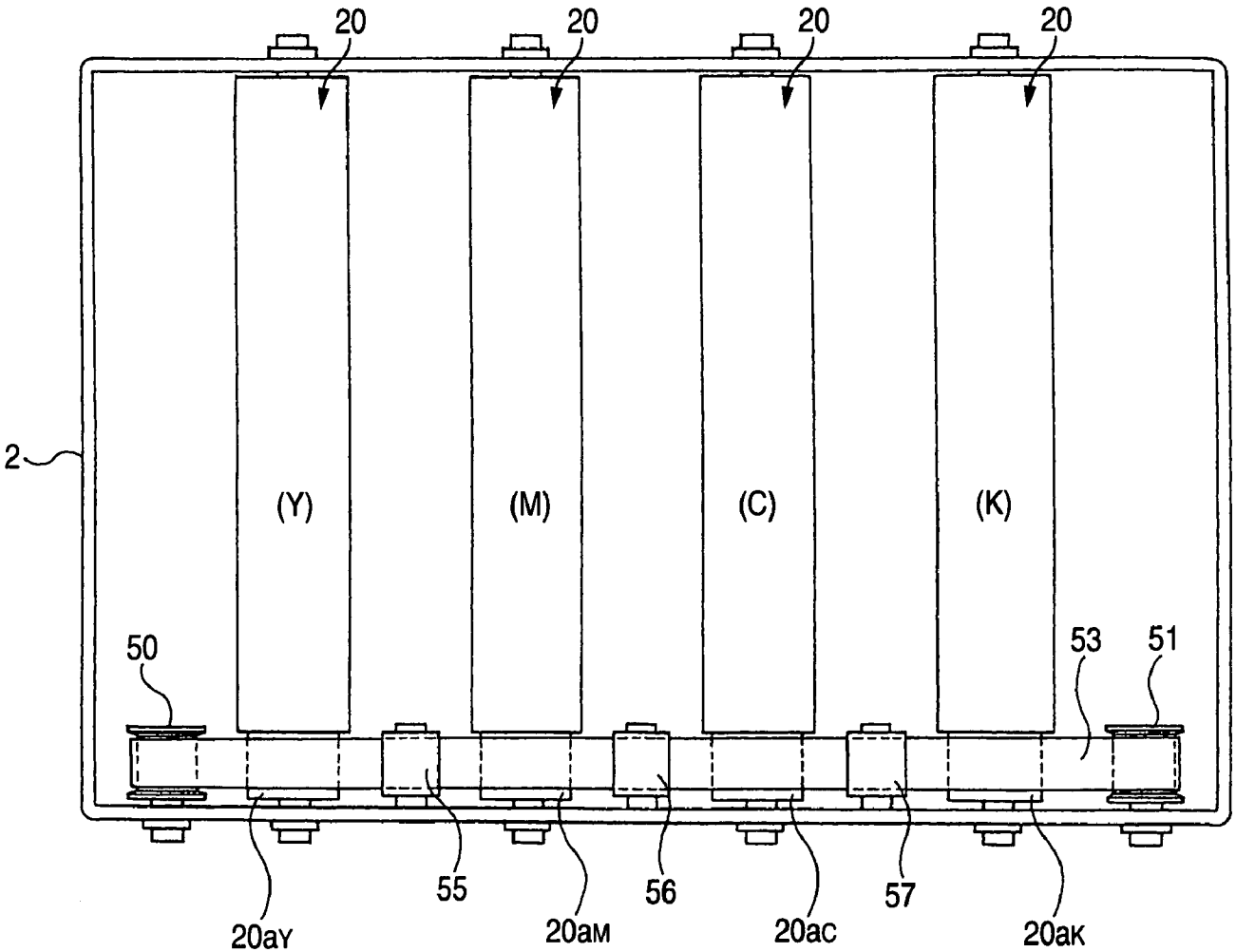
FIG. 12 is a bottom view typically showing the image bearing members and the image bearing member drive belt shown in FIG. 1.

As shown in FIGS. 11 and 12, an image bearing member driving pulley on a side closer to the driven roller 15 opposite to the driving roller 14 for the intermediate drive belt 16, and wherein an image bearing member driven pulley 51 is arranged on a side closer to the driving roller 14 for the intermediate transfer belt 16. Meanwhile, the image bearing member driving pulley 50 and image bearing member driven pulley 51 are arranged on one side widthwise (scanning direction) of the image bearing members (in the lower in FIG. 12). The image bearing member driving pulleys 50 are adapted to be driven by the image bearing member drive motor 52. In this case, the power of the image bearing member drive motor 52 is conveyed to the image bearing member drive pulley 50 through the motor gear 52*a* of image bearing member drive motor 52 and the pulley gear 50*a* of image bearing member drive pulley 50 that are in mesh with each other.

Image bearing member pulleys $\mathbf{20}a_Y$, $\mathbf{20}a_M$, $\mathbf{20}a_C$, $\mathbf{20}a_K$ are provided on one side of the image bearing members 20 respectively coaxially to and for rotation in one body with the corresponding image bearing members 20. The image bearing member pulleys $\mathbf{20}a_Y$, $\mathbf{20}a_M$, $\mathbf{20}a_C$, $\mathbf{20}a_K$ have their centers arranged on a line α parallel with the belt portion 16*a*, thus forming a row of image bearing member pulleys. Meanwhile, the image bearing member driving pulley 50 and the image bearing member driven pulley 51, having respective centers 50*b*, 51*a* somewhat deviated toward the intermediate transfer belt 16 from the straight line α, are arranged nearly on a line with the image bearing member pulley row of the image bearing member pulleys $\mathbf{20}a_Y$, $\mathbf{20}a_M$, $\mathbf{20}a_C$, $\mathbf{20}a_K$. In this case, the arrangement of image bearing member driving pulleys 50 and image bearing member driven pulley 51 nearly on a line refers to a degree that the centers 50*b*, 51*a* of the image bearing member drive pulley 50 and image bearing member driven pulley 51 are placed within a region defined between the common tangential lines β, γ on the outer peripheries of the image bearing member pulleys $\mathbf{20}a_Y$, $\mathbf{20}a_M$, $\mathbf{20}a_C$, $\mathbf{20}a_K$. Incidentally, the image bearing member driving pulley 50 and the image bearing member driven pulley 51 can have their centers 50*b*, 51*a* arranged on the straight line α, i.e. be arranged on a line with the image bearing member pulley row of the image bearing member pulleys $\mathbf{20}a_Y$, $\mathbf{20}a_M$, $\mathbf{20}a_C$, $\mathbf{20}a_K$.

One endless image bearing member drive belt 53 is stretched over between the image bearing member driving pulley 50 and the image bearing member driven pulley 51 so that the image bearing member drive belt 53 can be rotatively driven clockwise as shown in the figure of FIG. 11 by the image bearing member driving pulley 50. Namely, the belt portion 53*d* positioned at a loose-belt side of the image bearing member drive belt 53 and closer to the intermediate transfer belt 16 has a moving direction of obliquely lower light that is the same as the moving direction of the belt portion 16*a* of the intermediate transfer belt 16. Accordingly, the image bearing member driving pulley 50 is provided on the opposite side to the driving roller 14 for the intermediate transfer belt 16 with respect to a moving direction of the belt portions 16*a*, 53*d* of the both belt 16, 53. Incidentally, the intermediate transfer belt 16 and the image bearing member drive belt 53 can be set opposite in rotational direction. In such a case, arrangement order can be arbitrary set for the respective colors of image bearing members 20.

In the image forming apparatus 1 of this embodiment, the image bearing member drive motor 52 is driven upon forming an image, to rotatively drive the image bearing member driving pulley 50 clockwise in FIG. 11. By rotatively driving the image bearing member drive pulley 50, the image bearing member drive belt 53 is rotated similarly clockwise as shown by the arrow. Thereupon, because the image bearing member pulleys 20$a_Y$, 20$a_M$, 20$a_C$, 20$a_K$ are also rotatively driven similarly clockwise as shown by the arrow, the image bearing members 20 are rotated together in the same direction. Meanwhile, because the driving roller 14 is rotatively driven counterclockwise as shown by the arrow, the intermediate transfer belt 16 is also rotated counterclockwise.

When the intermediate transfer belt 16 and image bearing member drive belt 53 rotates in this manner, a certain degrees of elongation occurs on each of the intermediate transfer belt 16 and the image bearing member drive belt 53 despite the core member 53*c* suppresses against the elongation of the image bearing member drive belt 53. The elongation of the belt 16, 53 gives rise to a color misalignment in the primary transfer images in respective colors to be primarily transferred onto the belt portion 16*a*.

As shown in FIG. 13, of the color misalignments, as to the color misalignment resulting from an elongation of the intermediate transfer belt 16, color misalignment is minimal on the black (K) closest to the driving roller 14. Color misalignment increases due to integration as going distant from the driving roller 14, thus attaining the maximal color misalignment on the yellow (Y) the most distant from the driving roller 14. Namely, for color misalignment due to an elongation of the intermediate transfer belt 16, provided that the color misalignment amounts of black (K), cyan (C), magenta (M) and yellow (Y) are $a_K$, $a_C$, $a_M$ and $a_Y$, then the following results.

$$a_K<a_C<a_M<a_Y \tag{4}$$

Meanwhile, as for the color misalignment resulting from an elongation of the image bearing member driving belt 53, color misalignment is minimal on the yellow (Y) closest to the image bearing member driven pulley 50. Color misalignment increases due to integration as going distant from the image bearing member drive pulley 50, thus attaining the maximal color misalignment on the black (K) the most distant from the image bearing member driving belt 53. Namely, for color misalignment due to an elongation of the image bearing member drive belt 53, provided that the amounts of color misalignment concerning yellow (Y), magenta (M), cyan (C) and black (K) are respectively $b_Y$, $b_M$, $b_C$ and $b_K$, then the following results.

$$b_Y<b_M<b_C<b_K \tag{5}$$

Accordingly, the aggregated amounts of color misalignment as to black (K), cyan (C), magenta (M) and yellow (Y) are respectively $a_K+b_K$, $a_C+b_C$, $a_M+b_M$ and $a_Y+b_Y$. However, from the relationship between the foregoing expressions (4) and (5), the aggregated amounts of color misalignment are suppressed nearly to the even without causing a significant difference between the colors.

In this manner, according to the image forming apparatus 1 of this embodiment, because the image bearing member driving pulley 50 is provided on the side opposite to the driving roller 14 for the intermediate transfer belt 16 with respect to a moving direction of the belt portion 16*a* of intermediate transfer belt 16 opposed to the image bearing members 20 and the belt portion 53*d* of image bearing member driving belt 53 closer to the intermediate transfer belt 16, it is possible to suppress, to nearly the even, the total amounts of color misalignment resulting from an elongation of the intermediate transfer belt 16 and resulting from an elongation of the image bearing member drive belt 53. This can obtain a quality full-color image suppressed in the amount of color misalignment caused due to the elongations on the both belts 16, 53.

Meanwhile, because the image bearing member driving pulley 50 and the image bearing member driven pulley 51 are arranged nearly on a line or on a line with the image bearing member pulley rows of the image bearing member pulleys 20$a_Y$, 20$a_M$, 20$a_C$, 20$a_K$, the image bearing member drive belt 53 can be shortened in belt length. Because this can reduce the elongation of the image bearing member driving belt 53, the color misalignment due to a belt elongation can be suppressed further effectively. Moreover, there is no possibility that the image bearing member driving pulley 50 and image bearing member driven pulley 51 gors distant greatly in a direction orthogonal to the image bearing member pulley row from the image bearing member pulley row of the image bearing member pulleys 20$a_Y$, 20$a_M$, 20$a_C$, 20$a_K$. Thus, there is eliminated a need of a large arrangement space, enabling to improve compactness.

Figure 14:
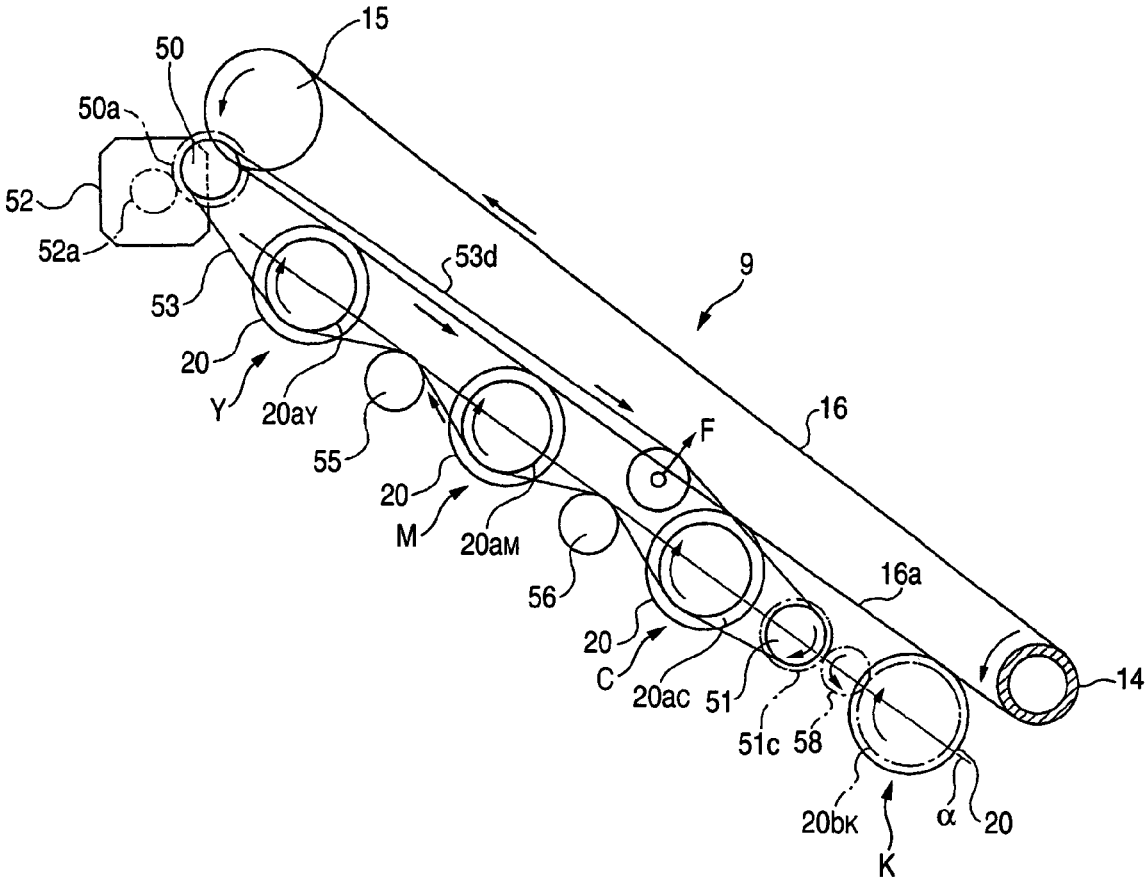
FIG. 14 is a view similar to FIG. 11, typically showing another example according a fourth embodiment of the invention.

FIG. 14 is a view similar to FIG. 11, typically showing an intermediate transfer belt and image bearing member driving belt in another example in the embodiment of the invention. Incidentally, the same constituent elements as those of the foregoing example are attached with the same references, thereby omitting the detailed explanations thereof.

Although the example shown in FIG. 11 was to rotatively drive the four image bearing members 20 by means of the image bearing member drive belt 53, the image forming apparatus 1 of this example is to rotatively drive three image bearing members for yellow (Y), magenta (M) and cyan (C) as shown in FIG. 14. Namely, an image bearing member driven pulley 51 is provided on a straight line ox at between the cyan (C) image bearing member 20 and the black (K) image bearing member 20. An image bearing member drive belt 53 is wound over the image bearing member driving pulley 50, the image bearing member driven pulley 51 and the image bearing member pulleys 20$a_Y$, 20$a_M$, 20$a_C$, 20$a_K$. Meanwhile, the idler pulley 57 is omitted so that the image bearing member drive belt 53 is urged onto three image bearing member pulleys 20$a_Y$, 20$a_M$, 20$a_C$ by two idler pulleys 55, 56.

Furthermore, there is provided a gear 51*c* coaxial to and for rotation in one body with the image bearing member driven pulley 51 while there is provided a gear 20$b_K$ coaxial to and for rotation in one body with the black (K) image bearing member driven pulley 51. These gears 51*c*, 20$b_K$ are rotatably coupled together through an intermediate gear 58. Accordingly, the rotation of the image bearing member drive belt 53 is conveyed to the gear 20$b_K$ through the gear 51$c$ and intermediate gear 58, thereby rotatively drive the black (K) image bearing member 20 clockwise in FIG. 14.

The other structure and operation of the image forming apparatus 1 of this embodiment is the same as the foregoing embodiments. Meanwhile, the operation effect of the image forming apparatus 1 of this example is substantially the same as the foregoing embodiments.

Incidentally, the foregoing examples explained the image forming apparatus of the invention by applying it to the image forming apparatus 1 having four different-colored image bearing members. However, the invention is not limited to that but can be applied to an image forming apparatus 1 having two or more of a plurality of image bearing members.

Meanwhile, although the foregoing examples provided the image bearing member driven pulley 51, the invention can omit the image bearing member driven pulley and be applied to an image forming apparatus having an image bearing member driving pulleys, similarly to the image forming apparatus disclosed in the JP-B-2806617.

The image forming apparatus of the present invention forms an electrostatic latent image on the image bearing members such as of an electronic photograph, an electrostatic copier, a printer or a facsimile machine, which can be suitably utilized as an image forming apparatus having a plurality of image bearing members arranged on a line and to be driven by one endless image bearing member drive belt, and an intermediate transfer belt to which toner images of the image bearing members are to be transferred.

Further, the image forming apparatus 1 may be configured that a cleaning unit for cleaning the intermediate transfer belt 16 is only provided to the image forming apparatus 1. This kind of an image forming apparatus is so called "photo conductor cleaner less system".

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

This application is based on Japanese Patent Application No. 2003-401341 filed on Dec. 1, 2003, 2003-401342 filed on Dec. 1, 2003, 2003-404780 filed on Dec. 3, 2003, and 2003-407554 filed on Dec. 5, 2003 the disclosure of which are incorporated herein by reference.

What is claimed is:

1. An image forming apparatus, comprising:

a plurality of image bearing members, respectively provided with image bearing member pulleys coaxially for rotating in one body with the corresponding image bearing members;

an idler pulley, disposed between the image bearing members;

a single drive belt, wound over the image bearing member pulleys for rotatively driving the image bearing member pulleys; and a tension pulley, adjusting a tension of the drive belt, wherein an image write-to-transfer time of the image bearing member which is disposed on a side closer to the tension pulley than the idler pulley is set integer times of a rotation period of the idler pulley.

2. The image forming apparatus according to claim 1, wherein the image write-to transfer time is a rotation period of time of the image bearing member from exposing position of an image to a primary transfer position.

3. The image forming apparatus according to claim 1, wherein the image bearing member on a side closer to the tension pulley are provided in plurality; and wherein image write-to-transfer times of all the image bearing members on a side closer to the tension pulley are set the integer times of the rotation period of the idler pulley.

4. The image forming apparatus according to claim 1, further comprising an image bearing member phase matching unit, matching phases of all the image bearing members disposed on a side closer to the tension pulley.

5. The image forming apparatus according to claim 1, wherein the idler pulley is provided in plurality, and wherein the image forming apparatus further comprising an idler pulley phase matching unit which matches phases of the idler pulleys.

6. The image forming apparatus according to claim 1, further comprising:

a drive member, rotatively driving the drive belt;

an intermediate transfer belt, onto which toner images are transferred from the image bearing members; and an intermediate transfer belt drive member, rotatively driving the intermediate transfer belt, wherein one of the image bearing members is for a black and the other is for other colors than black;

wherein the drive member is disposed on or near a line along a row of the image bearing member pulleys;

wherein the drive member is disposed at a same side as the intermediate transfer belt drive member with respect to a direction toward the intermediate transfer belt drive member in the line along the row of the image bearing member pulleys;

wherein the image bearing member for black is disposed in a closest position to the drive member; and wherein the image bearing member for less visible color of the colors other than black is disposed in a most distant position away from the drive member.

7. The image forming apparatus according to claim 6 wherein a moving speed of the drive belt is difference from a moving speed of the image bearing member drive belt.

8. The image forming apparatus according to claim 6 wherein the colors other than black of the image bearing member are yellow (Y), magenta (M) and cyan (C); and wherein the image bearing member for yellow (Y) is disposed in the most distant position away from the drive member.

9. The image forming apparatus according to claim 1, further comprising:

a drive member, rotatively driving the drive belt;

an intermediate transfer belt, onto which toner images are transferred from the image bearing members; and an intermediate transfer belt drive member, rotatively driving the intermediate transfer belt, wherein the drive member is disposed on or near a line along a row of the image bearing member pulleys;

wherein the drive member is disposed at a same side as the intermediate transfer belt drive member with respect to a direction toward the intermediate transfer belt drive member in the line along the row of the image bearing member pulleys; and wherein a correction for color misalignment under registration control is performed with a reference color for which the image bearing member is disposed in a closest position to the drive member.

10. The image forming apparatus according to claim 9, further comprising:

a main body; and an image bearing member support member, attached on the main body, wherein the image bearing member support member relatively positioning the image bearing members and rotatably supporting the image bearing members.

11. The image forming apparatus according to claim 9, further comprising positioning member, positioning the image bearing member support member in a predetermined position of the main body, wherein the positioning member is a shaft of the image bearing member for the reference color.

12. The image forming apparatus according to claim 1, further comprising:

a drive member, rotatively driving the drive belt;

an intermediate transfer belt, onto which toner images are transferred from the image bearing members; and an intermediate transfer belt drive member, rotatively driving the intermediate transfer belt, wherein one of the image bearing members is for a black and the other is for other colors than black;

wherein the drive member is disposed on or near a line along a row of the image bearing member pulleys; and wherein the drive member is disposed at a opposite side to the intermediate transfer belt drive member with respect to a direction toward the intermediate transfer belt drive member in the line along the row of the image bearing member pulleys.

13. The image forming apparatus according to claim 12 wherein a moving speed of the drive belt is difference from a moving speed of the image bearing member drive belt.

14. The image forming apparatus according to claim 12 wherein the image bearing members are either three image bearing members for yellow (Y), magenta (M) and cyan (C) or four image bearing members for yellow (Y), magenta (M), cyan (C) and black (K).

* * * * *